US006382771B1

(12) United States Patent
Ikeda et al.

(10) Patent No.: US 6,382,771 B1
(45) Date of Patent: May 7, 2002

(54) INK JET RECORDING APPARATUS AND INK JET RECORDING METHOD

(75) Inventors: Kouji Ikeda; Atsushi Sogami, both of Sanda (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/307,518

(22) Filed: May 7, 1999

(30) Foreign Application Priority Data

May 8, 1998 (JP) ..... 10-125675

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 40, 42, 32, 12, 13; 399/271, 290, 292, 293, 294, 295

(56) References Cited

U.S. PATENT DOCUMENTS 5,619,234 A * 4/1997 Nagato et al. ..... 347/55
5,975,683 A * 11/1999 Smith et al. ..... 347/55
6,086,186 A * 7/2000 Bergman et al. ..... 347/55
6,164,773 A * 12/2000 Oikawa ..... 347/100

* cited by examiner

*Primary Examiner*—Raquel Yvette Gordon
(74) *Attorney, Agent, or Firm*—Ratner & Prestia, PC

(57) ABSTRACT

An ink jet head 1 mounted on a carriage 2 in an ink jet recording apparatus according to the present invention performs a shuttling operation under the guidance of a carriage shaft 3. A high voltage of about −2 KV is applied between an opposite electrode 4 and the ink jet head 1 by a power source 5. An ink droplet 17 is ejected from the ink jet head 1 slantwise with respect to the opposite electrode 4, thus reducing a deviation between impact positions of large and small droplets.

18 Claims, 14 Drawing Sheets

Ld
$\frac{V_c\sqrt{8VexQ}}{2VexQ/d}$
0
$V_1$
$V_2$
$V_0$
θ=90°
θ=0°
902
901
$P_2$
$P_1$
$Q_2$
$Q_1$
$Q'_2$
$P'_2$
$V_1$
R
903
$V_2$
904
$P'_1$
$Q'_1$
$\theta_R$
90°
θ

| 1001 | 1002 | 1003 |
|---|---|---|
| Speed of carriage (mm/s) | Limit angle (°) at 17.7 μm or less | Limit angle (°) at −17.7 μm or less |
| 100 | 0.3 | 2.3 |
| 300 | 2.8 | 4.9 |
| 500 | 5.4 | 7.4 |
| 700 | 7.9 | 9.9 |
| 900 | 10.4 | 12.3 |
| 1100 | 12.8 | 14.7 |

| 1101 | 1102 | 1103 |
|---|---|---|
| Speed of carriage (mm/s) | Limit angle (°) at 8.8 μm or less | Limit angle (°) at −8.8 μm or less |
| 100 | | 2.7 |
| 300 | 1.4 | 4.7 |
| 500 | 3.4 | 6.7 |
| 700 | 5.4 | 8.6 |
| 900 | 7.4 | 10.6 |
| 1100 | 9.3 | 12.5 |

INK JET RECORDING APPARATUS AND INK JET RECORDING METHOD

BACKGROUND OF THE INVENTION

1. Field of the Invention

The present invention relates to an ink jet recording apparatus and a recording method, in which liquid such as ink is ejected from a fine nozzle, thereby forming a liquid pattern on recording paper or sheet so as to draw characters or graphics.

2. Description of the Related Art

In recent years, a printer using an ink jet recording apparatus has become widely pervasive as a printing apparatus for a personal computer or the like because of easy handling, excellent printing performance, a low cost or the like. Such ink jet recording apparatuses include various types, for example, a thermal type in which bubbles are generated in ink by thermal energy so as to eject ink droplets by pressure waves caused by the bubbles, an electrostatic type in which ink droplets are sucked to be ejected by electrostatic force, a piezoelectric type in which vibrator such as a piezoelectric element is used, or the like.

Furthermore, there has been proposed an amalgam of a piezoelectric system and an electrostatic system. For example, an amalgam of a piezoelectric system and an electrostatic system is disclosed in Japanese Patent Application Laid-Open No. 5-278212, which will be explained below in reference to FIG. 15. In FIG. 15, reference numeral 110 denotes a nozzle from which ink is ejected; 112, a pressure chamber communicating with the nozzle 110 and containing the ink therein; 115, a piezoelectric element for applying a pressure to the pressure chamber 112; 120, a convex ink meniscus formed at the tip of the nozzle 110; 108, a charging electrode for electrically charging the ink portion forming the ink meniscus 120; and 104, an opposite electrode disposed opposite to the charging electrode 108 via a recording sheet 107. A high voltage is applied between the charging electrode 108 and the opposite electrode 104 by a high voltage power source 105.

With this configuration, first, a voltage is applied to the piezoelectric element 115, so that a volume of the pressure chamber 112 is reduced by force generated by the piezoelectric element 115, thereby forming the ink meniscus 120 at the nozzle 110. Subsequently, when the ink meniscus 120 is electrically charged by the charging electrode 108, the ink is ejected from the ink meniscus 120 toward the opposite electrode 104 by an electric field formed between the charging electrode 108 and the opposite electrode 104. At this time, since the recording sheet 107 is interposed between the ink meniscus 120 and the opposite electrode 104, an ink image is formed on the recording sheet 107.

In FIG. 15, although the ink meniscus 120 is formed by the piezoelectric element 115, an ink droplet may be ejected. Normally, as the voltage to be applied to the piezoelectric element 115 is made higher, the diameter of the ink droplet to be ejected becomes greater and the ejection rate of the ink droplet becomes higher. In contrast, as the voltage to be applied to the piezoelectric element 115 is made lower, the diameter of the ink droplet to be ejected becomes smaller and the ejection rate of the ink droplet becomes lower. In the configuration shown in FIG. 15, it is possible to accelerate the ink droplet by electrostatic force and enhance the flying stability of the ink droplet even in the case where the voltage applied to the piezoelectric element 115 is made lower so that the diameter and ejection rate of the ink droplet to be ejected is made smaller and lower, respectively. Moreover, as the diameter of the nozzle 110 becomes smaller, clogging or the like is more liable to be generated and a manufacturing yield becomes worse. Consequently, in the ink jet recording apparatus, it is very useful to eject an ink droplet having a small diameter from a large-diameter nozzle. Therefore, in the configuration shown in FIG. 15, it is possible to provide an ink jet head in which the flying stability of a small-diameter droplet ejected from a large-diameter nozzle can be enhanced, clogging of the nozzle can be reduced, and a good manufacturing yield can be achieved.

However, although in the method illustrated in FIG. 15 a small droplet ejected from a nozzle having a large diameter is accelerated in an electrostatic field so as to enhance the flying stability of the ink droplet, the flying rate of the ink droplet is low since the ejection rate of the ink droplet is low. At the low flying rate of the ink droplet, a deviation of an impact position on the recording sheet 107 becomes great due to variations in flying rate, thereby deteriorating a quality of an image There arises no problem in the case where the relative moving speed between the recording sheet 107 and the nozzle 110 is low; whereas in the case where it is high, the deviation of the impact position becomes too great to be practical.

Additionally, in the case where the voltage to be applied to the piezoelectric element 115 can be varied so that the volume of the droplet to be ejected is changed for dot modulation in the method illustrated in FIG. 15, there arises the deviation of impact positions of a large dot (a large droplet) and a small dot (a small droplet) on the recording sheet 107. Although the deviation of the impact positions can be reduced more in the case where the electrostatic field is applied than in the case it is not applied, the deviation of the impact positions becomes too great to be practical in the case where the relative moving speed between the recording sheet 107 and the nozzle 110 is high.

SUMMARY OF THE INVENTION

The present invention has been accomplished in an attempt to solve the above problems observed in the prior art. An object of the present invention is to provide an ink jet head recording apparatus in which clogging in a nozzle can be reduced and a manufacturing yield is favorable by reducing the deviation of an impact position of an ink droplet in the case where a small droplet is ejected from a large-diameter nozzle.

Furthermore, another object of the present invention is to provide an ink jet recording apparatus in which dot modulation can be achieved by reducing the deviation of impact positions of a large droplet and a small droplet on a recording sheet.

One aspect of the present invention is an ink jet recording apparatus comprising:

an ink jet head for ejecting ink from a nozzle;

relative movement means for relatively moving said ink jet head and a recording sheet;

an opposite electrode disposed at a position opposite to said ink jet head; and voltage applying means for applying a voltage between said ink and said opposite electrode;

wherein an ejection direction of the ink to be ejected from said nozzle is inclined with respect to a direction of an electric field generated by said voltage applying means and has a component in a relative movement direction of said ink jet head relative to said recording sheet.

Another aspect of the present invention is an ink jet recording apparatus, wherein the direction of said electric field signifies a direction of an electric field in the vicinity of said opposite electrode;

the ejection direction of said ink being inclined with respect to the direction of said electric field signifies the ejection direction of said ink being inclined with respect to a plane perpendicular to the relative movement direction by said relative movement means; and the ejection direction of the ink to be ejected from said nozzle is parallel to or within a plane including a perpendicular line drawn from said nozzle down to said opposite electrode and a straight line drawn from said nozzle toward the relative movement direction by said relative movement means.

Still another aspect of the present invention is an ink jet recording apparatus, wherein said ink jet head includes: a pressure chamber containing said ink therein; the nozzle communicating with said pressure chamber and ejecting the ink; and pressure applying means for applying a pressure to said pressure chamber.

Yet another aspect of the present invention is an ink jet recording apparatus, further comprising pressure varying means for varying the pressure of said pressure applying means, so as to vary a quantity of the ink to be ejected from said nozzle.

Still yet another aspect of the present invention is an ink jet recording apparatus, wherein said pressure applying means includes a vibrating plate attached to said pressure chamber and a piezoelectric element for vibrating said vibrating plate, and said pressure varying means switches an energizing waveform to said piezoelectric element.

A further aspect of the present invention is an ink jet recording apparatus, wherein a nozzle surface having an ejection port of said nozzle is arranged slantwise with respect to a plane perpendicular to a perpendicular line drawn from said nozzle down to said opposite electrode, and said ink is ejected perpendicularly to said nozzle surface.

A still further aspect of the present invention is an ink jet recording apparatus, wherein a nozzle surface having an ejection surface of said nozzle is arranged in parallel with respect to a plane perpendicular to a perpendicular line drawn from said nozzle down to said opposite electrode, and said ink is ejected slantwise to said nozzle surface.

A yet further aspect of the present invention is an ink jet recording apparatus, wherein the axis of said nozzle is inclined with respect to said nozzle surface.

A still yet further aspect of the present invention is an ink jet recording apparatus, further comprising:

relative moving speed switching means for switching a relative moving speed between said ink jet head and said recording sheet which are relatively moved by said relative movement means; and ejection angle switching means for switching an ejection angle of the ink according to the relative moving speed between said ink jet head and said recording sheet.

One aspect of the present invention is an ink jet recording apparatus, wherein said relative movement means allows a shuttling operation of said ink jet head with respect to said recording sheet, the ink being ejected from said nozzle during both an advancing operation and a returning operation, wherein the ejection directions of ink droplets during the advancing and returning operations are symmetrical with respect to a plane perpendicular to the relative movement direction by said relative movement means.

Another aspect of the present invention is an ink jet recording method comprising the steps of:

inputting a desired recording quality;

switching a relative moving speed of an ink jet head for ejecting ink from a nozzle onto a recording sheet according to said recording quality; and switching an ejection direction of the ink to be ejected from said nozzle according to said relative moving speed.

Still another aspect of the present invention is an ink jet recording method, wherein the ejection direction of said ink is inclined with respect to a plane perpendicular to said relative movement direction, and has a component in the relative movement direction of said ink jet head with respect to said recording sheet.

Yet another aspect of the present invention is an ink jet recording method comprising the steps of:

determining a relative movement direction of an ink jet head for ejecting ink from a nozzle onto a recording sheet; and switching an ejection direction of the ink to be ejected from said nozzle according to said relative movement direction;

wherein the ejection direction of said ink is inclined with respect to a plane perpendicular to said relative movement direction, and has a component in the relative movement direction of said ink jet head with respect to said recording sheet.

Still yet another aspect of the present invention is an ink jet recording method, wherein said ink jet head or said recording sheet performs a shuttling operation, the ejection directions of said ink during advancing and returning operations are symmetrical with respect to the plane perpendicular to said relative movement direction.

BRIEF DESCRIPTION OF THE DRAWINGS

FIG. 9(*b*) is a graph illustrating the relationship between the ejection angles θ and the impact positions Ld, wherein the abscissa is changed to the ejection angles θ in the relationship between the ejection rates $V_1$ and the impact positions Ld shown in FIG. 9(*a*);

(Description of the Reference Numerals)

Figure 1:
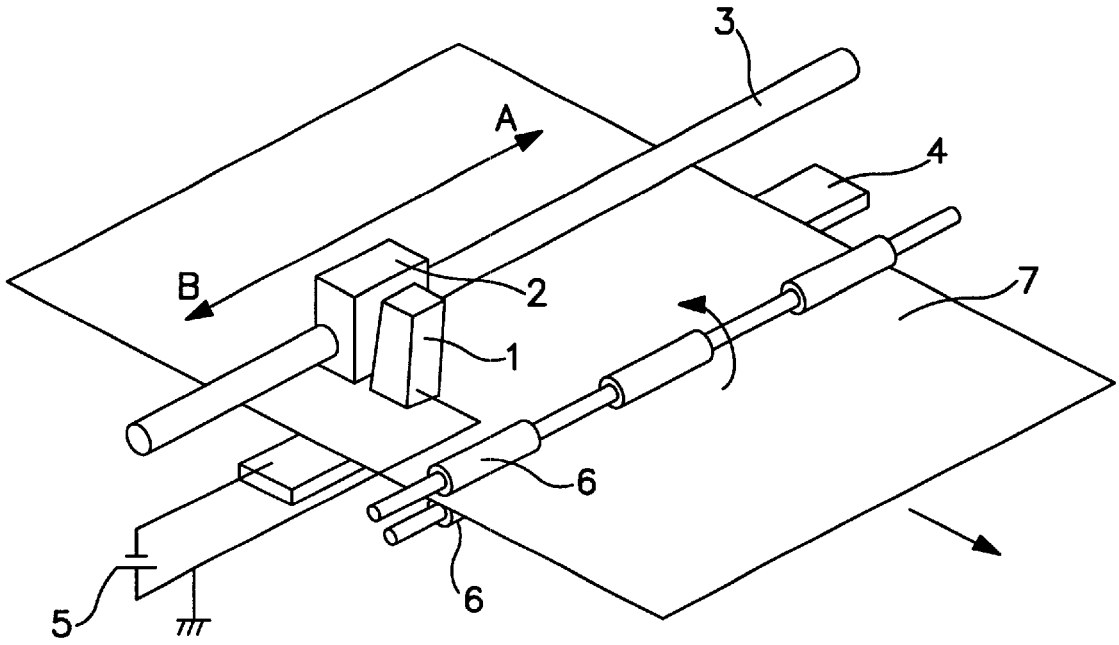
FIG. 1 is a schematic view showing the configuration of an ink jet recording apparatus in a first embodiment according to the present invention.

1 Ink jet head
2 Carriage
3 Carriage shaft
4 Opposite electrode
5 Power source
6 Recording sheet feeder
7 Recording sheet
8 Nozzle plate
9 Ink
10 Nozzle
11 Nozzle surface
12 Pressure chamber
13 Pressure chamber structure
14 Ink supply port
15 Piezoelectric element
16 Vibrating plate
17 Ink droplet
18 Eccentric cam
19 Ink-jet head rotating shaft

DESCRIPTION OF THE PREFERRED EMBODIMENTS

Embodiments of the present invention will now be described with reference to FIGS. 1 to 14.

(First Embodiment)

FIG. 1 is a schematic view showing the configuration of an ink jet recording apparatus in a first embodiment according to the present invention.

In FIG. 1, reference numeral 1 denotes an ink jet head, which is mounted on a carriage 2 and is configured in such a manner as to be driven by drive means, not shown, for a reciprocating operation under the guidance of a carriage shaft 3. The carriage 2, the carriage shaft 3 and the drive means constitute one example of relative movement means claimed in the section of "What Is Claimed Is." Reference numeral 4 denotes an opposite electrode made of metal with a distance of 1 mm from the ink jet head 1. To the opposite electrode 4 and the ink jet head 1, a high voltage of −1.8 KV is applied by a power source 5 in the state in which the side of the ink jet head 1 is grounded. The power source 5 is one example of voltage applying means claimed in the section of "WHAT IS CLAIMED IS." Reference numeral 6 denotes a recording sheet feeder, for feeding a recording sheet 7 in a direction perpendicular to the carriage shaft 3.

Figure 2:
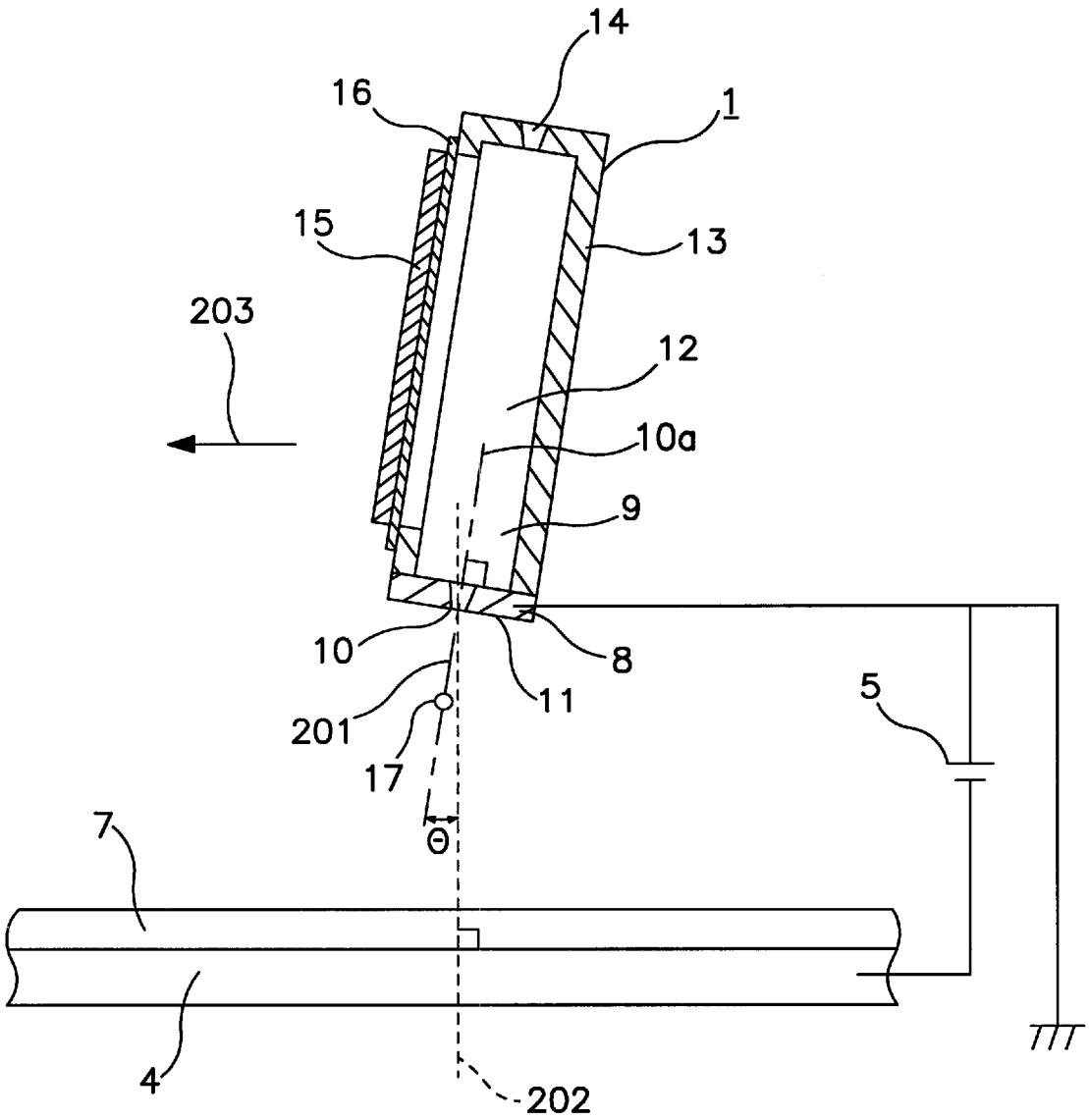
FIG. 2 is a cross-sectional view showing an ink jet head in the first embodiment according to the present invention.

Next, FIG. 2 is a cross-sectional view showing the ink jet head 1. In FIG. 2, reference numeral 8 denotes a nozzle plate made of stainless steel, having a nozzle 10 for ejecting ink 9. Between the nozzle plate 8 and the opposite electrode 4 is applied a high voltage of about −1.8 KV by the power source 5. Water ink is used as the ink 9. Reference numeral 11 denotes a nozzle surface, which is arranged in such a manner as to be inclined with respect to the opposite electrode 4. An axis 10*a* of the nozzle 10 is set perpendicularly to the nozzle surface 11. Reference numeral 12 denotes a pressure chamber communicating with the nozzle 10 and containing the ink 9 therein. Reference numeral 13 denotes a pressure chamber structure, which defines the pressure chamber 12 together with the nozzle plate 8. In the pressure chamber structure 13 is formed an ink supply port 14 for supplying the ink 9 to the pressure chamber 12. The ink supply port 14 communicates with a common liquid chamber and an ink tank, neither shown. Reference numeral 15 denotes a piezoelectric element made of PZT (here, $Pb(Zr_{0.53}Ti_{0.47})O_3$ is used) in a thickness of 0.02 mm, which is adapted to vibrate a vibrating plate 16 made of stainless steel in a thickness of 0.01 mm. Reference numeral 17 denotes an ink droplet to be ejected from the nozzle 10. Although only one pressure chamber 12 and only one nozzle 10 are shown in FIG. 2 which is the cross-sectional view, actually, there are provided a plurality of pressure chambers 12, each having one nozzle 10.

Explanation will be made below on the operation of the ink jet recording apparatus such configured as described above in reference to FIGS. 1 to 7, and simultaneously, a description will be given of an ink jet recording method in one embodiment according to the present invention.

First, the operation of the ink jet recording apparatus will be explained in reference to FIG. 1. In FIG. 1, the recording sheet feeders 6 feed the recording sheet 7 to a desired position. While the carriage 2 is moved from a position A to a position B by the device, not shown, the ink droplet 17 is ejected from the nozzle 10. Consequently, a recording image can be recorded on the recording sheet 7 by a quantity equivalent to one scanning of the ink jet head 1. Thereafter, while the carriage 2 is returned from the position B to the position A, the recording sheet feeders 6 feed the recording sheet 7 by a desired distance. Furthermore, while the carriage 2 is moved once again from the position A to the position B, the ink droplet 17 is ejected from the nozzle 10. In this way, a recording image is recorded on the recording sheet 7 by a quantity equivalent to one scanning of the ink jet head 1. This operation is repeated, so that the entire image can be formed on the recording sheet 7.

Subsequently, the ejection operation of the ink droplet 17 from the nozzle 10 will be explained below in reference to FIG. 2. A voltage is applied to the piezoelectric element 15. And then, the vibrating plate 16 is flexed together with the piezoelectric element 15 in a direction in which the volume of the pressure chamber 12 is reduced. Therefore, a pressure inside the pressure chamber 12 is increased, so that the ink 9 is ejected in the form of the ink droplet 17 from the nozzle 10 toward the recording sheet 7. At this moment, since the electrostatic field is applied between the nozzle plate 8 and the opposite electrode 4, a positive electric charge is induced before the ink 9 is turned into the ink droplet 17. Consequently, the ink 9 is turned into the positively charged ink droplet 17, to be ejected from the nozzle 10. Furthermore, the ink droplet 17 is flown toward the recording sheet 7 while being accelerated by the force of the electrostatic field.

At this time, even if the ejection rate of the ink droplet 17 is low, the ink droplet 17 is accelerated by the electrostatic force, to be easily landed at a desired position of the recording sheet 7.

Moreover, since the nozzle surface 11 is inclined with respect to the opposite electrode 4, the ink droplet 17 is ejected slantwise with respect to a perpendicular line drawn from the nozzle down to the opposite electrode 4. That is, the ink is ejected from the nozzle slantwise with respect to the direction of a positively electric field generated between the nozzle plate 8 and the opposite electrode 4. Hereinafter, such ejection is simply referred to as "slantwise ejection." Furthermore, the ejection direction 201 of the slantwise ejection is parallel to (or within) a plane including a perpendicular line 202 from the nozzle 10 down to the opposite electrode 4 (corresponding to the direction of the electric field in the vicinity of the opposite electrode 4) and a straight line from the nozzle 10 toward the relative movement direction 203 of the ink jet head 1 with respect to the recording sheet 7, and further, is oriented toward the relative movement direction of the ink jet head 1 with respect to the recording sheet 7.

Subsequently, the effects of the slantwise ejection will be explained based upon experimental data and simulation results. A theoretical explanation of the effects of the slantwise ejection will be explained later.

First, explanation will be made on required dimensions of the ink jet head 1 for use in experiments and simulations.

The width, depth and length of the pressure chamber are 0.34 mm, 0.16 mm and 2.2 mm, respectively. The width and length of the vibrating portion of the vibrating plate 16 are 0.34 mm and 2 mm, respectively. The width and length of the piezoelectric element 15 are 0.24 mm and 2 mm, respectively. The diameter of a small-diameter portion of each of the nozzle 10 and the ink supply port 14 is 0.035 mm.

Next, explanation will be made on the conditions of the experiments.

Figure 3:
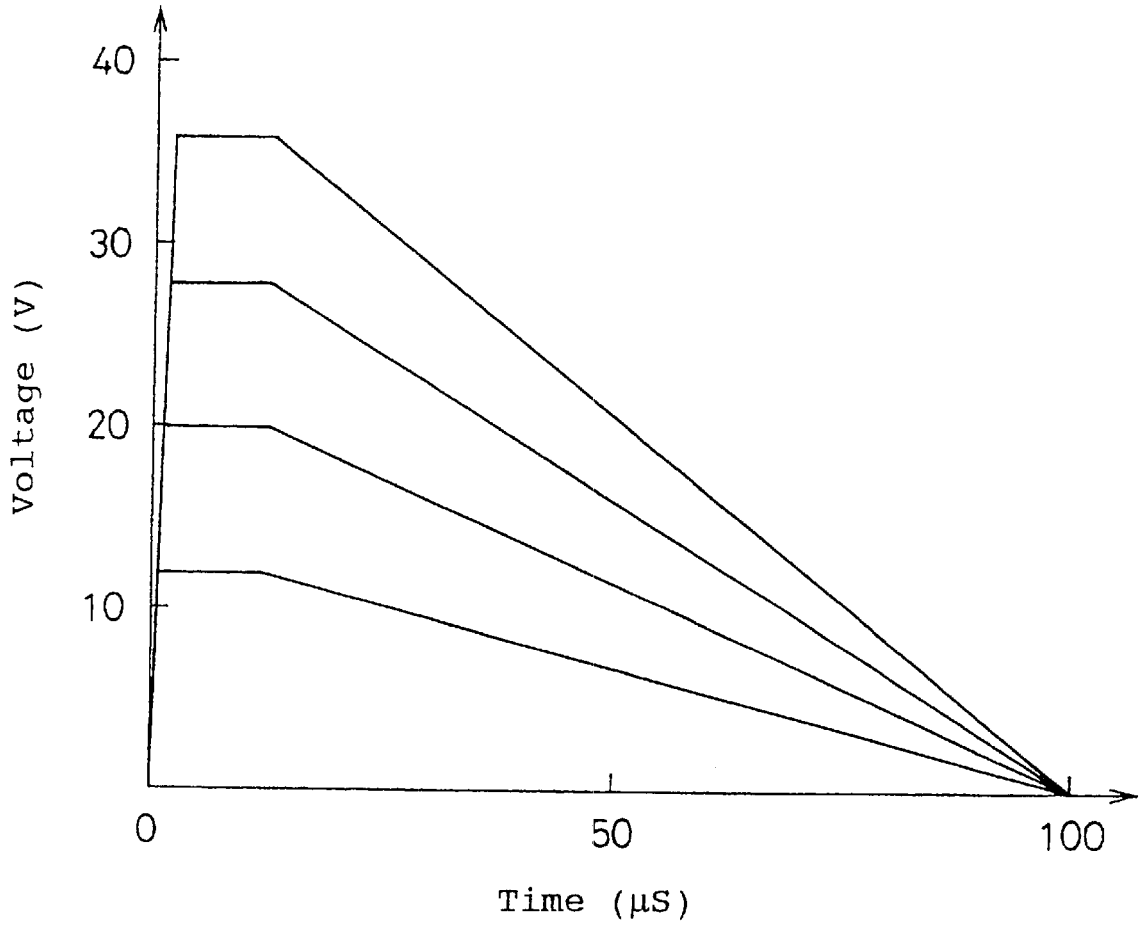
FIG. 3 is a graph illustrating voltage waveforms to be applied to a piezoelectric element in the first embodiment according to the present invention.
Figure 4:
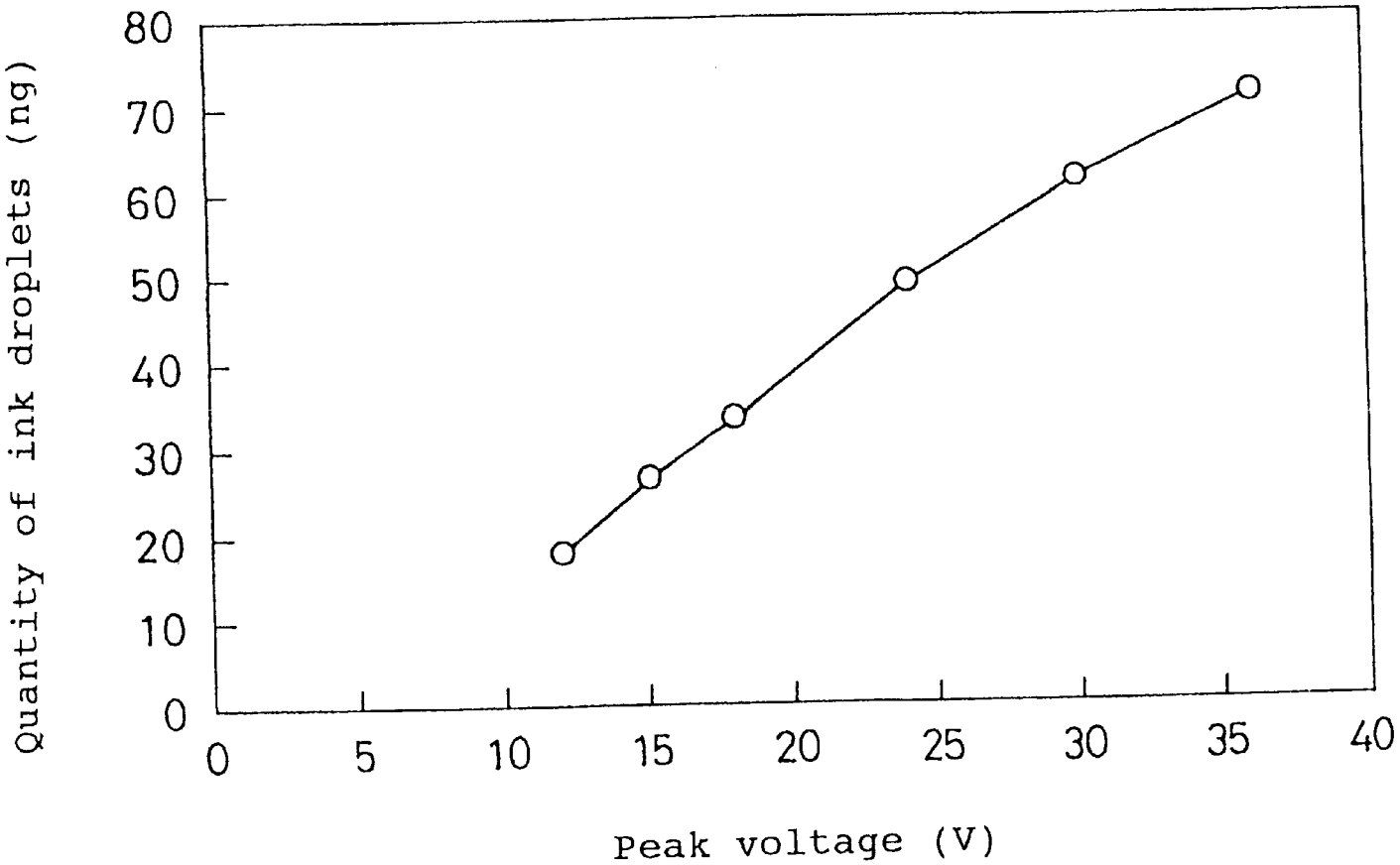
FIG. 4 is a graph illustrating the relationship between peak voltages in the voltage waveforms and a quantity of ink droplets in the first embodiment according to the present invention.

The relative moving speed of the ink jet head 1 was 500 mm/s. A gap between the ink jet head 1 and the recording sheet 7 was 1 mm. Consequently, the strength of the electric field in the gap was 1.8 kv/mm. FIG. 3 graphically shows voltage waveforms to be applied to the piezoelectric element 15. Peak voltages within the range of 12 V to 36 V were applied in the voltage waveforms graphically shown in FIG. 3. The experiments were conducted at a repeating cycle of 2 kHz and at the angles of the slantwise ejection of 0° to 16°. FIG. 4 graphically shows the peak voltages in the voltage waveforms and the masses of the ink droplets 17 when the voltage waveforms graphically shown in FIG. 3 were applied to the piezoelectric element 15. The experimental results show that there was no difference between the case where the electrostatic field was applied and the case where it was not applied, and further, that the mass of the ink droplets 17 became greater as the peak voltage became higher.

Figure 5:
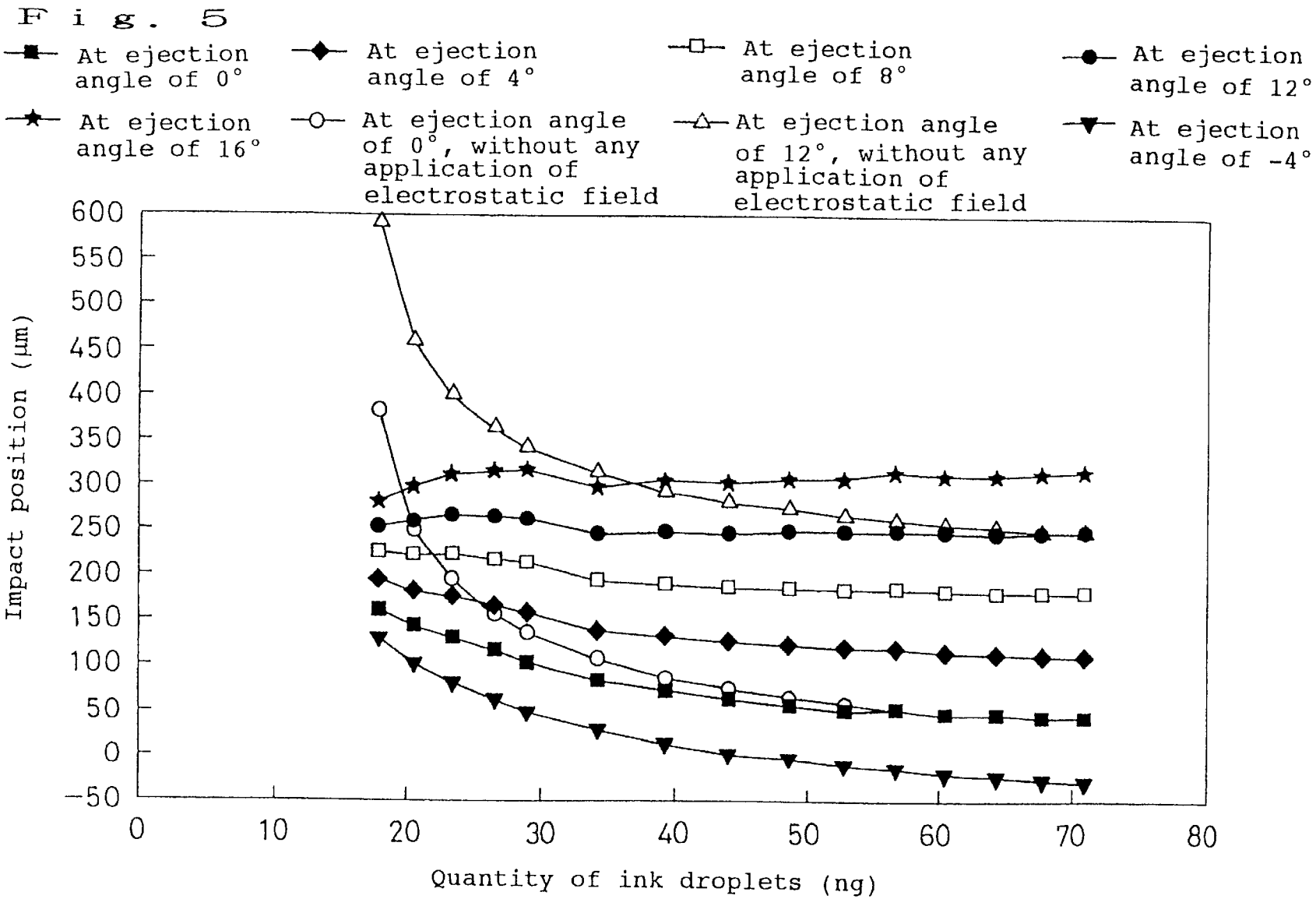
FIG. 5 is a graph illustrating the relationship between the quantity of ink droplets and impact positions of the ink droplets in the first embodiment according to the present invention.

Subsequently, Table 1 and FIG. 5 illustrate the relationship between the mass of the ink droplets 17 and the impact positions on the recording sheet 7 in the case where the voltage waveforms illustrated in FIG. 3 were applied. Here, an intersection between the perpendicular line drawn from the nozzle 10 down to the opposite electrode 4 and the recording sheet 7 when the voltage was started to be applied to the piezoelectric element 15 was used as an origin, and a distance from the origin to the actual impact position of the ink droplet 17 on the recording sheet 7 was defined as an impact position. Table 1 and FIG. 5 illustrate the relationship at each of the angles of the slantwise ejection of 0°, 4°, 8°, 12° and 16°, respectively, and at the same time, illustrate the case where the electrostatic field was not applied and the ink droplet was ejected straight and the cases where the electrostatic field was not applied and the ink droplet was ejected at the angles of 12° and −4°, respectively. In Table 1 and FIG. 5, the state at the angle of the slantwise ejection of 0° resulted from the experiment, but the states of the other angles of the slantwise ejection resulted from the simulations by using theoretical equations described later.

As apparent from these results, variations of ±0.06 mm in impact position are generated within the range of 18 ng to 72 ng of the ink droplets (corresponding to the dot modulation system in which small droplets and large droplets are ejected) in the case where the electrostatic field is applied and the ink droplet is ejected straight (at the ejection angle of 0°). In this case, it is not practical although the deviation of the impact position can be considerably reduced more than the case where the electrostatic field is not applied. The greater the quantity of the ink droplets is, the higher the ejection rate becomes. The ejection rate is 1.3 m/s at 18 ng of the quantity of the ink droplets; and 11.6 m/s, at 72 ng.

The deviation of the impact position becomes considerably great at the slantwise ejection angle of −4°. Although the deviation of the impact position can be reduced if the electrostatic field is made stronger, the limit of the electrostatic field is almost −4 KV/mm, wherein the deviation of the impact position becomes ±0.04 mm. This is not practical. Moreover, in the case where the electrostatic field is strengthened, it is difficult to set the gap between the ink jet head 1 and the opposite electrode 4 to 1 mm or less, Consequently, it is necessary to increase the applied voltage, thereby unfavorably raising problems in a cost of the apparatus, insulating measures or the like.

In contrast, the deviation of the impact position can be suppressed within ±0.011 mm within the range of 18 ng to 72 ng of the ink droplets when the angle of the slantwise ejection is 12°.

TABLE 1

| Quantity of Ink Droplets (ng) | Impact Position (μm) with Application of Electrostatic Field, at 0° | Impact Position (μm) with Application of Electrostatic Field, at 4° | Impact Position (μm) with Application of Electrostatic Field, at 8° | Impact Position (μm) with Application of Electrostatic Field, at 12° | Impact Position (μm) with Application of Electrostatic Field, at 16° | Impact Position (μm) without Application of Electrostatic Field, at 0° | Impact Position (μm) without Application of Electrostatic Field, at 12° | Impact Position (μm) with Application of Electrostatic Field, at −4° |
|---|---|---|---|---|---|---|---|---|
| 17.6 | 165.0 | 194.9 | 224.6 | 254.1 | 283.1 | 385.0 | 592.9 | 132.2 |
| 20.3 | 142.5 | 182.3 | 221.8 | 261.0 | 299.6 | 250.0 | 457.9 | 100.8 |
| 23.2 | 130.0 | 176.5 | 222.8 | 268.6 | 313.8 | 195.0 | 402.9 | 82.0 |
| 26.2 | 115.0 | 165.9 | 216.6 | 266.8 | 316.3 | 157.5 | 365.4 | 63.0 |
| 28.6 | 105.0 | 158.9 | 212.4 | 265.5 | 317.8 | 136.0 | 343.9 | 50.3 |

TABLE 1-continued

| Quantity of Ink Droplets (ng) | Impact Position (μm) with Application of Electrostatic Field, at 0° | Impact Position (μm) with Application of Electrostatic Field, at 4° | Impact Position (μm) with Application of Electrostatic Field, at 8° | Impact Position (μm) with Application of Electrostatic Field, at 12° | Impact Position (μm) with Application of Electrostatic Field, at 16° | Impact Position (μm) without Application of Electrostatic Field, at 0° | Impact Position (μm) without Application of Electrostatic Field, at 12° | Impact Position (μm) with Application of Electrostatic Field, at −4° |
|---|---|---|---|---|---|---|---|---|
| 34.0 | 84.0 | 138.5 | 192.7 | 246.5 | 299.4 | 107.5 | 315.4 | 28.9 |
| 39.1 | 73.0 | 131.9 | 190.4 | 248.5 | 305.6 | 86.5 | 294.4 | 13.7 |
| 43.8 | 64.5 | 125.3 | 185.8 | 245.7 | 304.7 | 74.0 | 281.9 | 3.4 |
| 48.5 | 59.5 | 122.4 | 185.0 | 246.9 | 308.0 | 66.0 | 273.9 | −3.6 |
| 52.7 | 54.5 | 118.9 | 183.1 | 246.5 | 309.1 | 59.0 | 266.9 | −10.2 |
| 56.7 | 52.5 | 119.1 | 185.3 | 251.0 | 315.6 | 55.0 | 262.9 | −14.3 |
| 60.4 | 48.0 | 115.0 | 181.6 | 247.6 | 312.6 | 50.0 | 257.9 | −19.2 |
| 64.3 | 46.5 | 114.1 | 181.3 | 247.9 | 313.5 | 48.0 | 255.9 | −21.3 |
| 67.6 | 43.8 | 112.7 | 181.3 | 249.3 | 316.3 | 44.3 | 252.2 | −25.4 |
| 70.9 | 43.3 | 113.0 | 182.4 | 251.2 | 318.9 | 43.3 | 251.2 | −26.7 |

Consequently, it is not practical because the deviations of the impact positions become great if the large droplets and the small droplets are ejected at the relative moving speed of 500 mm/s in the case where the ink droplet 17 is ejected straight even if the electrostatic field is applied. In contrast, the deviations of the impact positions can be reduced both in the case of the ejection of large droplets and in the case of the ejection of small droplets in the case where the ink droplet 17 is ejected slantwise with the application of the electrostatic field; namely, it is possible to achieve so-called dot modulation.

Next, explanation will be made on the operation of the slantwise ejection in the case of not dot modulation but binary recording. Normally, although the quantity of ink droplets can be reduced if the peak voltage is decreased, the ejection rate of the ink droplet 17 becomes lower. In such a state, the deviation of the impact position is markedly influenced by the variation in ejection rate.

In FIG. 5, the deviation of the impact position was ±0.073 mm without any application of the electrostatic field (at the ejection angle of 0°) when the quantity of the ink droplets was 20 ng ±2 ng. As a result, from the point of view of the deviation of the impact position, it is impossible to put into practice the method in which the quantity of the ink droplets is decreased by reducing the peak voltage, thereby ejecting the small ink droplets from the large-diameter nozzle. In contrast, the deviation of the impact position was ±0.016 mm in the case where the ink droplets were ejected straight with the application of the electrostatic field. Furthermore, the deviation of the impact position was ±0.002 mm in the case of the slantwise ejection (at the ejection angle of 12°). The application of the electrostatic field can reduce the deviation of the impact position, and the slantwise ejection can further reduce the deviation of the impact position.

As described above, in the first embodiment, the slantwise ejection in the electrostatic field can reduce the deviations of the impact positions of the large and small ink droplets, thus providing the ink jet recording apparatus capable of the dot modulation.

The slantwise ejection in the electrostatic field produces the effects in conducting the dot modulation, and further, can reduce the deviation of the impact position even in the case of the ejection of the small droplet from the large-diameter nozzle at the time of the binary recording. The ejection of the small droplet from the large-diameter nozzle can prevent clogging and provide the ink jet recording apparatus which is manufactured at a good yield.

Although the angle of the slantwise ejection of 12° is preferable in the present embodiment, it is to be understood that an optimum ejection angle depends upon the conditions such as the gap between the nozzle 10 and the opposite electrode 4 and the relative moving speed.

Figure 6:
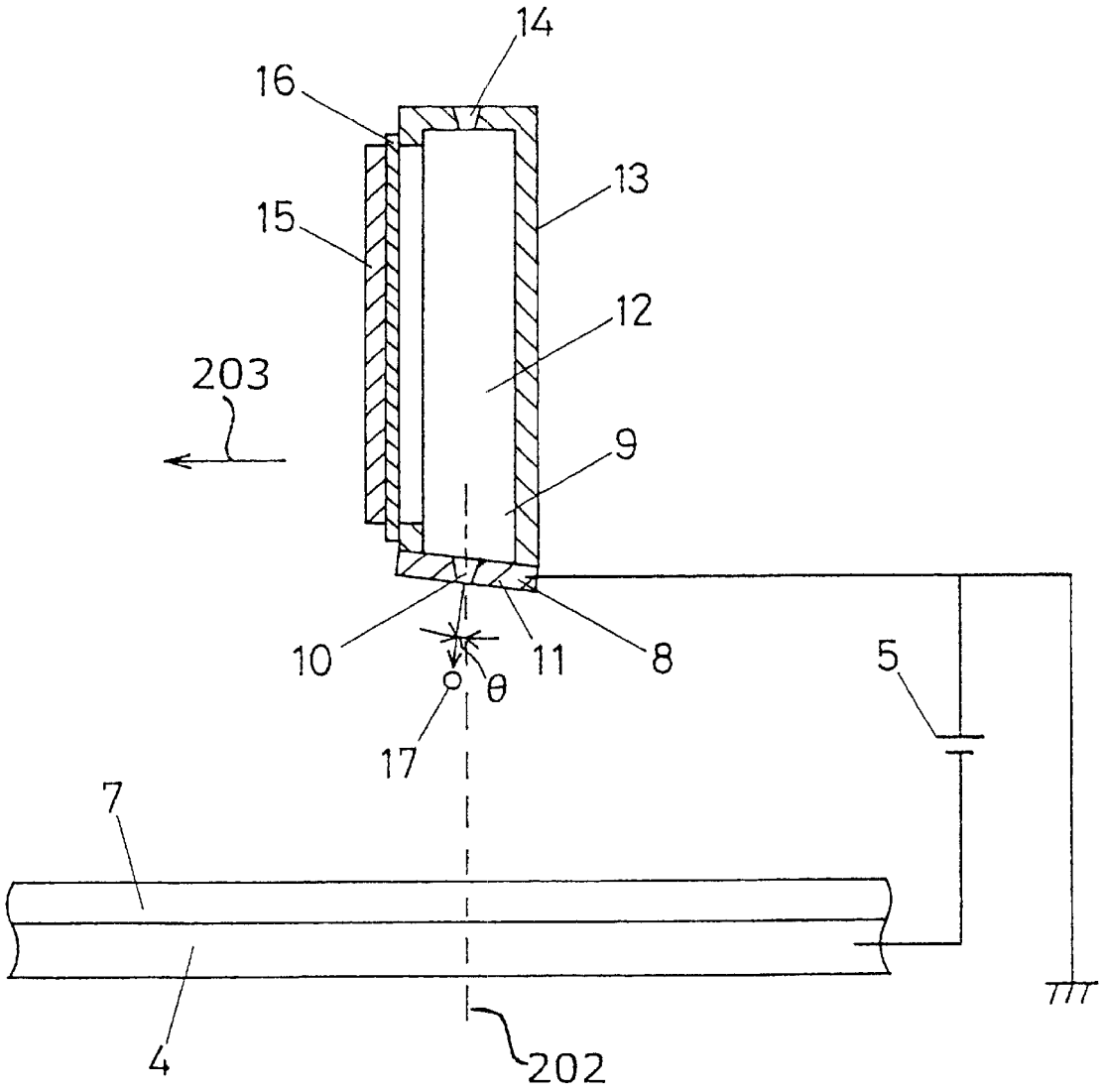
FIG. 6 is a view illustrating another slantwise ejecting method in the first embodiment according to the present invention.

Although the nozzle surface 11 is configured to be perpendicular to the longitudinal direction of the pressure chamber 12 in the present embodiment, the nozzle surface 11 may be inclined with respect to the longitudinal direction of the pressure chamber 12, as shown in FIG. 6.

Figure 7:
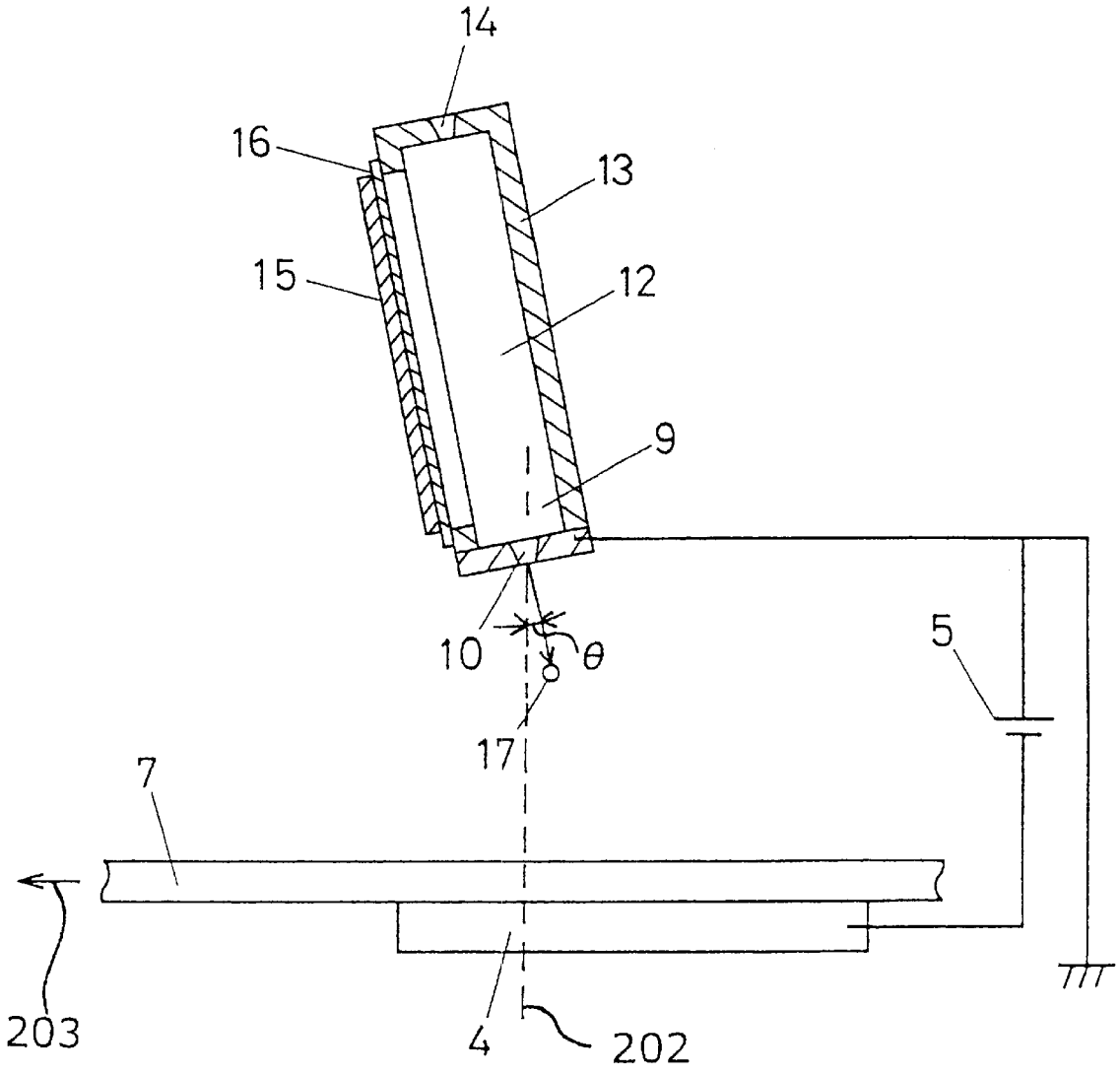
FIG. 7 is a cross-sectional view showing the ink jet head in the first embodiment according to the present invention.

Although the ink jet head 1 is moved with respect to the recording sheet 7 in the present embodiment, the ink jet head 1 may be stationary while the recording sheet 7 may be moved. The direction of the slantwise ejection in this case is shown in FIG. 7.

Although the direction of the slantwise ejection is parallel to the plane including the perpendicular line drawn from the nozzle 10 down to the opposite electrode 4 and the straight line drawn from the nozzle 10 toward the relative movement direction of the ink jet head 1 with respect to the recording sheet 7 in the present embodiment and is oriented toward the relative movement direction of the ink jet head 1 with respect to the recording sheet 7, the direction of the slantwise ejection may be oriented toward a direction intersecting the above-described plane within the range where no problem is arisen in view of the image as long as the direction of the slantwise ejection is oriented toward the above-described relative movement direction.

Although the piezoelectric element 15 and the vibrating plate 16 are used as the pressure applying means for the ink ejection in the present embodiment, such pressure applying means may include means for generating bubbles in the ink by thermal energy, high frequency energy means by the use of a piezoelectric element, means for fusing solid ink so as to eject the fused ink by the use of a piezoelectric element, or the like.

Figure 8:
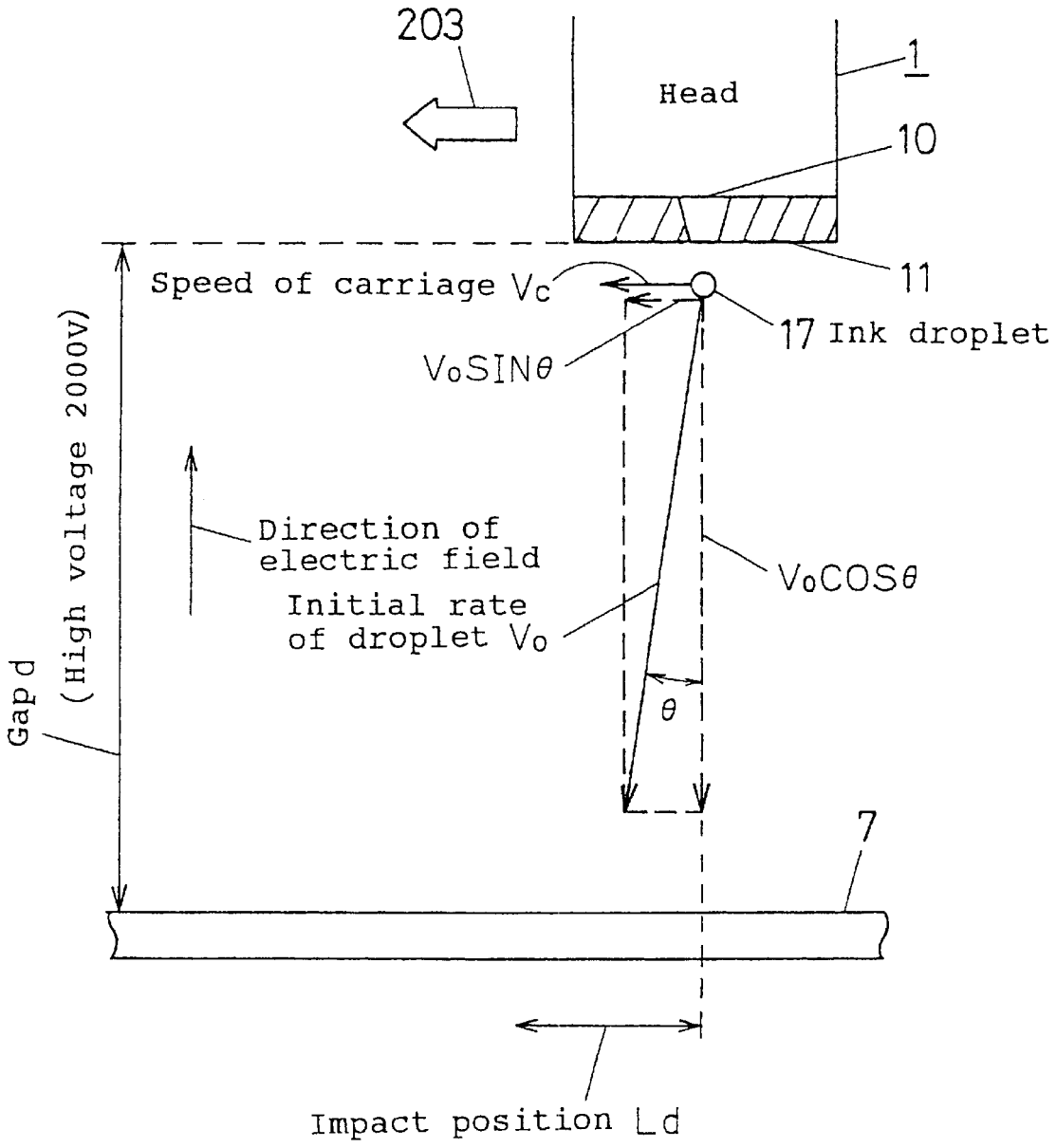
FIG. 8 is a schematic cross-sectional view illustrating the ink jet recording apparatus for the explanation of the concept and effects of "slantwise ejection" in the embodiment.

Subsequently, as described above, the effects of "the slantwise ejection" in the present embodiment will be theoretically described in reference to FIGS. 8 and 9. FIG. 8 is a schematic cross-sectional view illustrating the ink jet recording apparatus for the explanation of the principle and effects of the slantwise ejection in the present embodiment.

First, the equation expressing the impact position Ld of the droplet can be introduced as follows:

The density of electric charges in the droplet is represented by q (=9 $\mu_0$/g); the speed of the ink jet head (also referred to as the speed of the carriage), Vc (=500 mm/sec); the lapse of time after the ejection of the droplet from the nozzle, t; the gap between the ink jet head and the recording sheet, d (=1 mm); the voltage for generating the electric field, Ve (=−1800 V/mm); the ejection rate of the droplet from the nozzle, $V_0$; and the ejection angle of the droplet from the nozzle, θ.

Under the above-described conditions force F of the electrostatic field acting on the droplet is expressed by Equation 1. The acceleration acting on the droplet can be expressed by Equation 2 with transformation of Equation 1.

$$F=ma=mqVe/d \quad \text{(Equation 1)}$$

$$a=Ve\cdot q/d \quad \text{(Equation 2)}$$

Meanwhile, the ejection rate $V_0$ of the droplet is expressed by $V_0 \sin\theta$ as a horizontal component and $V_0 \cos\theta$ as a vertical component, as illustrated in FIG. 8. As a result, in consideration of the acceleration expressed by Equation 2, a horizontal rate component Vh and a vertical rate component Vv of the droplet are expressed by Equations 3 as follows:

$$Vh=Vc+V_0 \sin\theta \quad \text{(Equation 3)}$$

$$Vv=V_0 \cos\theta+(Ve\cdot q/d)t$$

Thus, the flying distance of the droplet will be expressed by Equations 4 and 5 as follows:

$$L=(Vc+V_0 \sin\theta)t \quad \text{(Equation 4)}$$

$$Lv=V_0 \cos\theta\cdot t+(Ve\cdot q/2d)t^2 \quad \text{(Equation 5)}$$

wherein L represents the distance in the horizontal direction; and Lv, the distance in the vertical direction.

Here, the time when the distance Lv in the vertical direction becomes equal to d, that is, a time $t_d$ until the droplet reaches the recording sheet 7 will be expressed by Equation 6 as follows:

$$t_d=\{-2V_0 \cos\theta+(4V_0^2 \cos^2\theta+8Ve\cdot q)^{1/2}\}d/2Ve\cdot q \quad \text{(Equation 6)}$$

Therefore, the impact position Ld of the droplet can be obtained by substituting $t_d$ for Equation 4.

$$Ld=(Vc+V_0 \sin\theta)t_d \quad \text{(Equation 7)}$$

Next, for the comparison with the present invention, explanation will be made on the impact position in the case where the electric field is zero and the droplet is ejected slantwise, based upon Equations 4 to 7.

That is to say, Lv=d and Ve=0 are substituted for Equation 5, thereby obtaining the following equation:

$$d=V_0 \cos\theta\cdot t \quad \text{(Equation 8)}$$

From this equation, the impact time t is expressed by the following Equation 9:

$$t=d/(V_0 \cos\theta) \quad \text{(Equation 9)}$$

When Equation 9 is substituted for Equation 4, the impact position L is expressed by the following Equation 10:

$$L=(Vc+V_0\sin\theta)d/(V_0\cos\theta) \quad \text{(Equation 10)}$$

$$=(dVc/\cos\theta)/V_0+(\sin\theta/\cos\theta)d$$

As apparent from Equation 10, the higher the ejection rate $V_0$ of the droplet is, namely, the larger the quantity of the droplet is, the smaller the reciprocal $1/V_0$ becomes, and accordingly, the shorter the impact distance L becomes. With respect to the different ejection rates $V_0$, there exists no ejection angle θ at which their impact distances L become equal to each other.

Consequently, it is found that it is theoretically impossible to equalize the impact distances of the large and small droplets to each other.

Subsequently, a description will be given of that there can exist the ejection angles θ at which the impact positions of the large and small droplets accord with each other by the slantwise ejection in the present embodiment, wherein the impact positions at the angles of 0° and 90° are exemplified for simple explanation.

In case of 0°, θ=0 is substituted for Equation 6, thereby obtaining the following Equation 11:

$$t_d=\{-2V_0+(4V_0^2+8Ve\cdot q)^{1/2}\}d/2Ve\cdot q \quad \text{(Equation 11)}$$

Furthermore, when this Equation 11 is substituted for Equation 7, the impact position Ld will be expressed by the following Equation 12:

$$Ld=Vc\cdot t_d \quad \text{(Equation 12)}$$

$$=Vc\left\{-2V_0+(4V_0^2+8Ve\cdot q)^{\frac{1}{2}}\right\}d/2Ve\cdot q$$

Here, $V_0=0$ and $V_0=\infty$ are substituted for Equation 12, thus obtaining the following Equations 13:

$$Ld=Vc(8Ve\cdot q)^{1/2}d/2Ve\cdot q(\text{wherein } V_0=0) \quad \text{(Equation 13)}$$

$$Ld=0(\text{wherein } V_0=0)$$

Figures 9A, 9B:
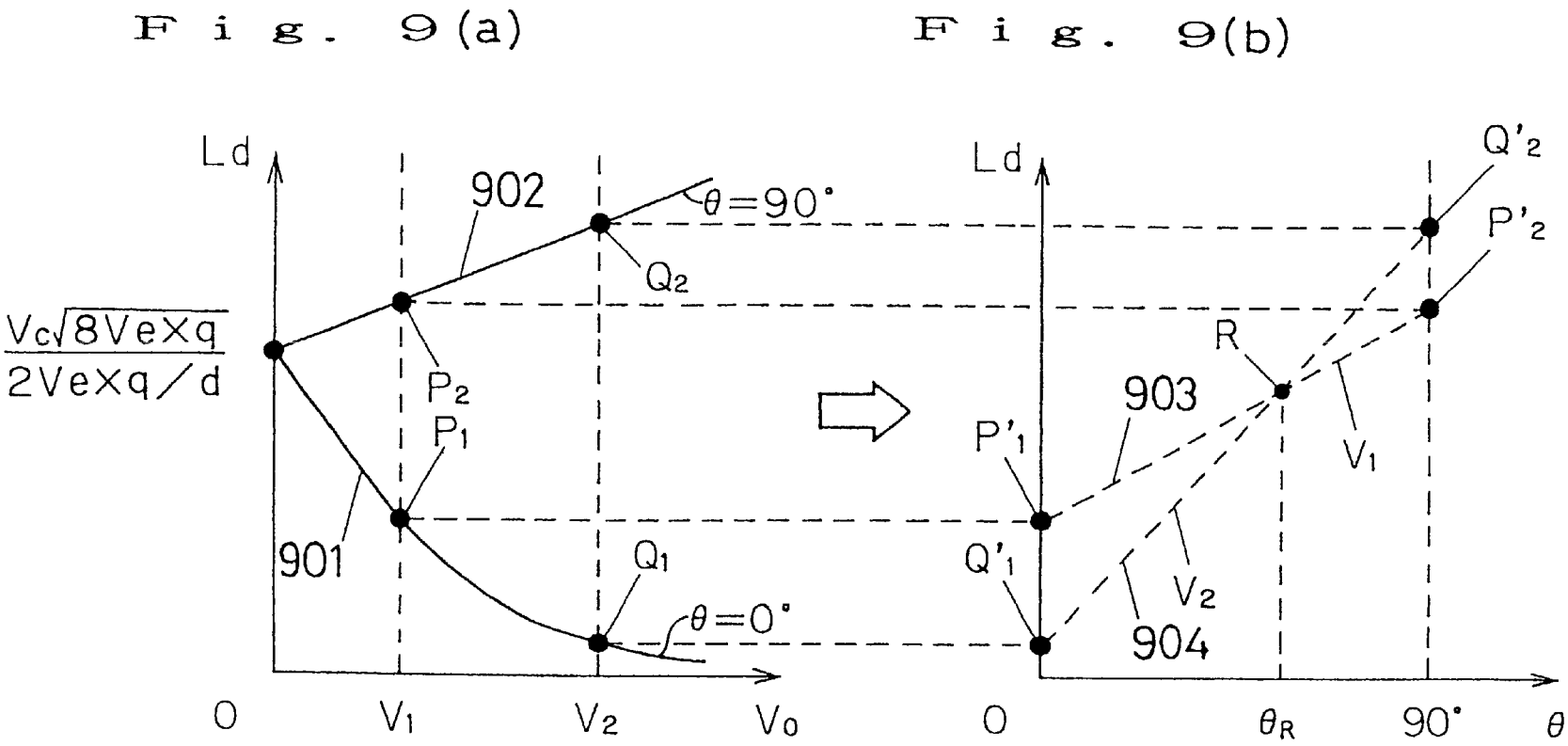
FIG. 9(*a*) is a graph illustrating the relationship between ejection rates $V_0$ and impact positions Ld, wherein ejection angle θ range from 0° to 90°.

Therefore, the relationship between Ld and $V_0$ in Equation 12 is expressed by a curve 901 graphically shown in FIG. 9(*a*).

Next, in case of 0=90°, θ=90 is substituted for Equation 6, thus obtaining the following Equation 14:

$$t_d=\{8Ve\cdot q)^{1/2}d/2Ve\cdot q \quad \text{(Equation 14)}$$

Furthermore, this Equation 14 is substituted for Equation 7, the impact position Ld is expressed by the following Equation 15:

$$Ld=(Vc+V_0)t_d \quad \text{(Equation 15)}$$

$$=(Vc+V_0)(8Ve\cdot q)^{\frac{1}{2}}d/2Ve\cdot q$$

Here, when Equation 15 is arranged by representing the term $(8Ve\cdot q)^{1/2}d/2Ve\cdot q$ by k, it is expressed by the following Equation 16, which is a linear function of $V_0$ intersecting the Ld axis at $kV_0$.

$$Ld=kV_0+kV_0 \quad \text{(Equation 16)}$$

As a result, the relationship between Ld and $V_0$ in Equation 16 is expressed by a straight line 902 in FIG. 9(*a*).

The curve 901 and the straight line 902 representing the relationship between the impact position Ld and the ejection rate $V_0$ which are obtained in the above-described mariner are converted into straight lines 903 and 904 representing the relationship between the impact position Ld and the ejection angle θ in FIG. 9(*b*). In FIGS. 9(*a*) and 9(*b*), points $P_1$ and $P_2$ correspond to $P'_1$ and $P'_2$, respectively; and $Q_1$ and $Q_2$ correspond to $Q'_1$ and $Q'_2$, respectively.

In other words, as apparent from FIG. 9(*a*), the curve 901 indicates that the impact position Ld becomes smaller in the case of the large droplet (for example, at the ejection rate $V_2$) than the case of the small droplet (for example, at the ejection rate $V_1$); the straight line 902 indicates that the impact position Ld becomes greater in the large droplet than in the small droplet. Moreover, from FIG. 9(*a*), it is found that in the case where the droplet is ejected slantwise, that is, the ejection angle θ ranges from 0° to 90°, the coordinates representing the relationship between the impact position and the ejection rate exist between the curve 901 and the straight line 902.

Meanwhile, it is apparent that changes in impact position Ld with respect to the ejection angle θ at a certain ejection rate $V_1$ may be drawn continuously, although it is not always a straight line, since it is clear that the line 903 (i.e., the line connecting the points $P'_1$ and $P'_2$) becomes continuous in consideration of the continuity of a physical phenomenon. This is true for the line 904 connecting the points $Q'_1$ and $Q'_2$.

Therefore, both the continuous lines 903 and 904 always intersect at a point R at an angle between 0° and 90°. The impact position of the large droplet (at the ejection rate of $V_2$) accords with that of the small droplet (at the ejection rate of $V_1$) at the ejection angle $\theta_R$ of the intersection R.

As a result, it is found that there always exists an ejection angle θ (0°<θ<90°) at which the respective impact positions of the large and small droplets accord with each other according to the slantwise ejection in the present embodiment.

Subsequently, explanation will be made below on the simulation results for determining an optimum angle (limit angle) of the slantwise ejection based upon Equation 7 or the like for determining the impact position of the droplet.

First, there will be described only conditions different from the conditions established for the simulation as described in the above Table 1.

Here, a moving speed of the carriage ranges from 100 to 1100 mm/sec; the gap d is 1.5 mm; the applied voltage Ve for generating the electric field is −3 kv; and accordingly, the strength of the electric field is 2 kv/mm. The other conditions are the same as described above.

Although the ejection rates $V_0$ of the ink droplet in this simulation are basically 1.3 m/s, 2.5 m/s and 11.6 m/s, these values correspond to 18 ng, 20 ng and 72 ng of the quantity of the ink droplets, respectively.

Next, there will be explained an allowable range, which is required for dot modulation, of a deviation between the impact positions of the large droplet (72 ng) and the small droplet (18 ng). The impact position is defined as described above.

Namely, if the density of a pixel in recording is 360 dpi, a pitch of the pixel is 70.6 μm based upon the following Equation 17:

$$25.4\times10^3/360=70.6(\mu m) \quad \text{(Equation 17)}$$

If a deviation between the impact positions of the large and small droplets ranges within ±¼ pixel, recording can be performed with excellent dot modulation. In this case, the allowable range of the deviation between both the droplets falls within ±17.7 μm.

Moreover, explanation will be made below on an allowable range of a deviation between the impact positions in the case where the small droplet (20 ng) is ejected from the large-diameter nozzle (corresponding to binary recording).

In this case, if the deviation between the impact positions of the small droplets ranges within ±⅛ pixel, excellent recording can be performed. Consequently, the allowable range of the deviation between the impact positions of the droplets falls within ±8.8 μm.

Here, the reason why the allowable range is set rigorously in comparison with the allowable range in the case of the dot modulation is as follows: namely, such nature is considered that the deviation between the impact positions of the large and small droplets generally appears inconspicuous to human eyes if the variations in deviation are slight; whereas the deviation of the impact positions of only the small droplets appears conspicuous to human eyes.

In the present embodiment, the deviation between the impact positions of the small droplets (20 ng) which are ejected from the large-diameter nozzle was calculated as caused by the variations in ejection rate (2.5 m/s ±30%). Such variations in ejection rate are caused by variations in quantity (20 ng) of the small droplets to be ejected per se.

Figures 10A, 10B:
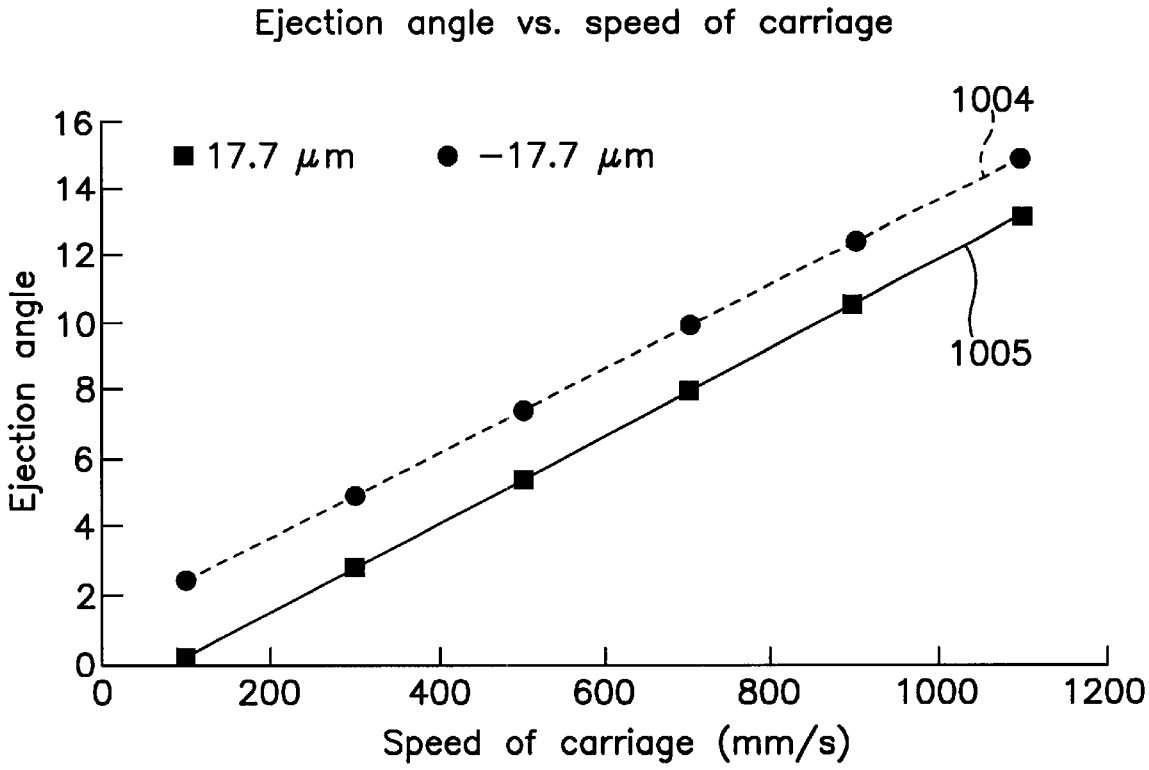
FIGS. 10(*a*) and 10(*b*) are a table and a graph illustrating the relationship between speeds Vc of a carriage and limit values of the ejection angles θ of droplets, wherein deviations fall within an allowable range (±17.7 μm)

First the respective simulations in the case where the large droplets (72 ng) and the small droplets (18 ng) are ejected are explained in reference to FIGS. 10(*a*) and 10(*b*). FIGS. 10(*a*) and 10(*b*) are a table and a graph illustrating the relationship between the speeds Vc of the carriage and the limit values of the ejection angles θ of the droplets in which the deviation falls within the above-described allowable range (±17.7 μm). A specific method for calculating the limit values of the ejection angles θ will be described later.

In FIG. 10(*a*), a column denoted by reference numeral 1001 represents the moving speeds (mm/s) of the carriage; a column denoted by reference numeral 1002, the limit values of the ejection angles θ at which the deviation between the impact positions of the large and small droplets becomes ±17.7 μm or less in such a manner as to correspond to the speed of the carriage in the column 1001; and a column denoted by reference numeral 1003, the limit values of the ejection angles θ at which the deviation between the impact positions of the large and small droplets becomes −17.7 μm or less.

For example, in order to make the deviation of the impact positions fall within the range of ±17.7 μm when the moving speed of the carriage is 500 mm/s, it is found from FIG. 10(*a*) that the ejection angle θ is needed to be set within the range of 5.4°≦θ≦7.4°.

FIG. 10(*b*) graphically shows the results illustrated in FIG. 10(*a*). In FIG. 10(*b*), the ejection angles θ existing in the coordinates between a straight line 1004 and a straight line 1005 fall within the allowable range with respect to a certain speed of the carriage.

Subsequently, explanation will be made on a method for determining the limit values of the ejection angles at the moving speed of the carriage of 500 mm/s in reference to Tables 2 to 4.

Tables 2 to 4 illustrate the simulation results of the impact positions of the large droplets (at the ejection rate of 11.6 m/s) and the small droplets (at the ejection rate of 1.3 m/s) and the differences (deviations) between the respective impact positions when the ejection angles θ are varied from 5° to 7.9° in increments of 0.1°.

As apparent from Table 2, the impact positions of the small droplets and the large droplets at the ejection angle θ of, for example, 5.4° are 0.0002041 m (204.1 μm) and 0.0001876 m (187.6 μm), respectively. The deviation between both the impact positions is 16.5 (μm) obtained by subtracting 187.6 from 204.1. At the ejection angle θ of 5.3°, the deviation between both the impact positions is almost 18.2 (μm), which exceeds ±17.7 (μm) of the limit value of the allowable range.

From the above results, the ejection angle θ of 5.4° becomes one limit angle determining the allowable range.

TABLE 2

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 1.3 | 5 | 1.2950534 | 3000 | 0.0015 | 0.01 | 0.0003279 | 4.5742672 | 0.5 | 0.0002011 | 23.126125 |
| 11.6 | 5 | 11.555861 | 3000 | 0.0015 | 0.01 | 0.0001178 | 12.733826 | 0.5 | 0.000178 | |
| 1.3 | 5.1 | 1.2948537 | 3000 | 0.0015 | 0.01 | 0.0003279 | 4.5741509 | 0.5 | 0.0002019 | 21.473713 |
| 11.6 | 5.1 | 11.554079 | 3000 | 0.0015 | 0.01 | 0.0001178 | 12.732195 | 0.5 | 0.0001804 | |
| 1.3 | 5.2 | 1.29465 | 3000 | 0.0015 | 0.01 | 0.0003279 | 4.5740322 | 0.5 | 0.0002026 | 19.820618 |
| 11.6 | 5.2 | 11.552262 | 3000 | 0.0015 | 0.01 | 0.0001178 | 12.730532 | 0.5 | 0.0001828 | |
| 1.3 | 5.3 | 1.2944424 | 3000 | 0.0015 | 0.01 | 0.0003279 | 4.5739113 | 0.5 | 0.0002034 | 18.166829 |
| 11.6 | 5.3 | 11.550409 | 3000 | 0.0015 | 0.01 | 0.0001178 | 12.728836 | 0.5 | 0.0001852 | |
| 1.3 | 5.4 | 1.2942309 | 3000 | 0.0015 | 0.01 | 0.000328 | 4.5737881 | 0.5 | 0.0002041 | 16.512333 |
| 11.6 | 5.4 | 11.548522 | 3000 | 0.0015 | 0.01 | 0.0001179 | 12.727108 | 0.5 | 0.0001876 | |
| 1.3 | 5.5 | 1.2940154 | 3000 | 0.0015 | 0.01 | 0.000328 | 4.5736626 | 0.5 | 0.0002048 | 14.857117 |
| 11.6 | 5.5 | 11.546599 | 3000 | 0.0015 | 0.01 | 0.0001179 | 12.725349 | 0.5 | 0.00019 | |
| 1.3 | 5.6 | 1.293796 | 3000 | 0.0015 | 0.01 | 0.000328 | 4.5735349 | 0.5 | 0.0002056 | 13.20117 |
| 11.6 | 5.6 | 11.544641 | 3000 | 0.0015 | 0.01 | 0.0001179 | 12.723557 | 0.5 | 0.0001924 | |
| 1.3 | 5.7 | 1.2935726 | 3000 | 0.0015 | 0.01 | 0.000328 | 4.5734048 | 0.5 | 0.0002063 | 11.544478 |
| 11.6 | 5.7 | 11.542648 | 3000 | 0.0015 | 0.01 | 0.0001179 | 12.721733 | 0.5 | 0.0001948 | |
| 1.3 | 5.8 | 1.2933453 | 3000 | 0.0015 | 0.01 | 0.000328 | 4.5732724 | 0.5 | 0.0002071 | 9.8870309 |
| 11.6 | 5.8 | 11.54062 | 3000 | 0.0015 | 0.01 | 0.0001179 | 12.719876 | 0.5 | 0.0001972 | |
| 1.3 | 5.9 | 1.2931141 | 3000 | 0.0015 | 0.01 | 0.000328 | 4.5731377 | 0.5 | 0.0002078 | 8.2288147 |
| 11.6 | 5.9 | 11.538556 | 3000 | 0.0015 | 0.01 | 0.0001179 | 12.717988 | 0.5 | 0.0001996 | |

Table 3 illustrates the simulation results of the deviations between the impact positions at the ejection angles θ ranging from 6.0° to 6.9°. It is clearly found from Table 3 that the ejection angle θ at which the impact positions of the large and small droplets substantially accord with each other is 6.4°.

TABLE 3

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 1.3 | 6 | 1.2928789 | 3000 | 0.0015 | 0.001 | 0.000328 | 4.5730008 | 0.5 | 0.0002086 | 6.5698175 |
| 11.6 | 6 | 11.536458 | 3000 | 0.0015 | 0.01 | 0.000118 | 12.716068 | 0.5 | 0.000202 | |
| 1.3 | 6.1 | 1.2926398 | 3000 | 0.0015 | 0.01 | 0.000328 | 4.5728615 | 0.5 | 0.0002093 | 4.9100268 |
| 11.6 | 6.1 | 11.534324 | 3000 | 0.0015 | 0.01 | 0.000118 | 12.714115 | 0.5 | 0.0002044 | |
| 1.3 | 6.2 | 1.2923967 | 3000 | 0.0015 | 0.01 | 0.000328 | 4.57272 | 0.5 | 0.0002101 | 3.2494304 |
| 11.6 | 6.2 | 11.532155 | 3000 | 0.0015 | 0.01 | 0.000118 | 12.71213 | 0.5 | 0.0002068 | |
| 1.3 | 6.3 | 1.2921497 | 3000 | 0.0015 | 0.01 | 0.000328 | 4.5725762 | 0.5 | 0.0002108 | 1.5880159 |
| 11.6 | 6.3 | 11.529951 | 3000 | 0.0015 | 0.01 | 0.000118 | 12.710114 | 0.5 | 0.0002092 | |
| 1.3 | 6.4 | 1.2918988 | 3000 | 0.0015 | 0.01 | 0.0003281 | 4.5724301 | 0.5 | 0.0002116 | −0.074229 |
| 11.6 | 6.4 | 11.527712 | 3000 | 0.0015 | 0.01 | 0.000118 | 12.708065 | 0.5 | 0.0002116 | |
| 1.3 | 6.5 | 1.2916439 | 3000 | 0.0015 | 0.01 | 0.0003281 | 4.5722817 | 0.5 | 0.0002123 | −1.737318 |
| 11.6 | 6.5 | 11.525438 | 3000 | 0.0015 | 0.01 | 0.0001181 | 12.705984 | 0.5 | 0.000214 | |
| 1.3 | 6.6 | 1.2913851 | 3000 | 0.0015 | 0.01 | 0.0003281 | 4.572131 | 0.5 | 0.0002131 | −3.401261 |
| 11.6 | 6.6 | 11.523129 | 3000 | 0.0015 | 0.01 | 0.0001181 | 12.703871 | 0.5 | 0.0002165 | |
| 1.3 | 6.7 | 1.2911224 | 3000 | 0.0015 | 0.01 | 0.0003281 | 4.571978 | 0.5 | 0.0002138 | −5.066073 |
| 11.6 | 6.7 | 11.520784 | 3000 | 0.0015 | 0.01 | 0.0001181 | 12.701726 | 0.5 | 0.0002189 | |
| 1.3 | 6.8 | 1.2908557 | 3000 | 0.0015 | 0.01 | 0.0003281 | 4.5718228 | 0.5 | 0.0002145 | −6.731765 |
| 11.6 | 6.8 | 11.518405 | 3000 | 0.0015 | 0.01 | 0.0001181 | 12.699549 | 0.5 | 0.0002213 | |
| 1.3 | 6.9 | 1.2905851 | 3000 | 0.0015 | 0.01 | 0.0003281 | 4.5716652 | 0.5 | 0.0002153 | −8.39835 |
| 11.6 | 6.9 | 11.51599 | 3000 | 0.0015 | 0.01 | 0.0001181 | 12.69734 | 0.5 | 0.0002237 | |

As apparent from Table 4, the impact positions of the small droplets and the large droplets at the ejection angle θ of, for example, 7.4° are 0.000219 m (219 μm) and 0.0002358 m (235.8 μm), respectively. The deviation between both the impact positions is −16.8 (μm) obtained by subtracting 235.8 from 219. At the ejection angle θ of 7.5°, the deviation between both the impact positions is almost −18.4 (μm), which exceeds −17.7 (μm) of the limit value of the allowable range.

From the above results, the ejection angle θ of 7.4° becomes the other limit angle determining the allowable range.

TABLE 4

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 1.3 | 7 | 1.2903106 | 3000 | 0.0015 | 0.01 | 0.0003281 | 4.5715054 | 0.5 | 0.000216 | −10.06584 |
| 11.6 | 7 | 11.51354 | 3000 | 0.0015 | 0.01 | 0.0001182 | 12.695099 | 0.5 | 0.0002261 | |
| 1.3 | 7.1 | 1.2900321 | 3000 | 0.0015 | 0.01 | 0.0003281 | 4.5713433 | 0.5 | 0.0002168 | −11.73425 |
| 11.6 | 7.1 | 11.511056 | 3000 | 0.0015 | 0.01 | 0.0001182 | 12.692826 | 0.5 | 0.0002285 | |
| 1.3 | 7.2 | 1.2897497 | 3000 | 0.0015 | 0.01 | 0.0003281 | 4.5711789 | 0.5 | 0.0002175 | −13.40359 |
| 11.6 | 7.2 | 11.508536 | 3000 | 0.0015 | 0.01 | 0.0001182 | 12.690521 | 0.5 | 0.0002309 | |
| 1.3 | 7.3 | 1.2894634 | 3000 | 0.0015 | 0.01 | 0.0003282 | 4.5710122 | 0.5 | 0.0002183 | −15.07387 |
| 11.6 | 7.3 | 11.505981 | 3000 | 0.0015 | 0.01 | 0.0001182 | 12.688183 | 0.5 | 0.0002334 | |
| 1.3 | 7.4 | 1.2891731 | 3000 | 0.0015 | 0.01 | 0.0003282 | 4.5708433 | 0.5 | 0.000219 | −16.7451 |
| 11.6 | 7.4 | 11.503391 | 3000 | 0.0015 | 0.01 | 0.0001182 | 12.685814 | 0.5 | 0.0002358 | |
| 1.3 | 7.5 | 1.288879 | 3000 | 0.0015 | 0.01 | 0.0003282 | 4.5706721 | 0.5 | 0.0002198 | −18.41731 |
| 11.6 | 7.5 | 11.500766 | 3000 | 0.0015 | 0.01 | 0.0001183 | 12.683413 | 0.5 | 0.0002382 | |
| 1.3 | 7.6 | 1.2885809 | 3000 | 0.0015 | 0.01 | 0.0003282 | 4.5704986 | 0.5 | 0.0002205 | −20.0905 |
| 11.6 | 7.6 | 11.498106 | 3000 | 0.0015 | 0.01 | 0.0001183 | 12.68098 | 0.5 | 0.0002406 | |
| 1.3 | 7.7 | 1.2882788 | 3000 | 0.0015 | 0.01 | 0.0003282 | 4.5703228 | 0.5 | 0.0002213 | −21.76467 |
| 11.6 | 7.7 | 11.495411 | 3000 | 0.0015 | 0.01 | 0.0001183 | 12.678515 | 0.5 | 0.000243 | |
| 1.3 | 7.8 | 1.2879729 | 3000 | 0.0015 | 0.01 | 0.0003282 | 4.5701447 | 0.5 | 0.000222 | −23.43986 |
| 11.6 | 7.8 | 11.492681 | 3000 | 0.0015 | 0.01 | 0.0001183 | 12.676018 | 0.5 | 0.0002455 | |
| 1.3 | 7.9 | 1.287663 | 3000 | 0.0015 | 0.01 | 0.0003282 | 4.5699643 | 0.5 | 0.0002228 | −25.11606 |
| 11.6 | 7.9 | 11.489916 | 3000 | 0.0015 | 0.01 | 0.0001184 | 12.673489 | 0.5 | 0.0002479 | |

As apparent from the above description, the same simulation as described above is conducted while the moving speed of the carriage is changed, thus obtaining the limit values of the ejection angles illustrated in FIG. 10(*a*).

As a consequence, it is found from FIG. 10(*b*) that in order to achieve the dot modulation at the moving speed of the carriage of 400 mm/s or higher, the ejection angle of the ink droplet is needed to be at least 4° or more.

Next, the simulation in the case where the small droplets (20 ng) are ejected from the large-diameter nozzle will be explained below in reference to FIGS. 11(*a*) and 11(*b*).

Figures 11A, 11B:
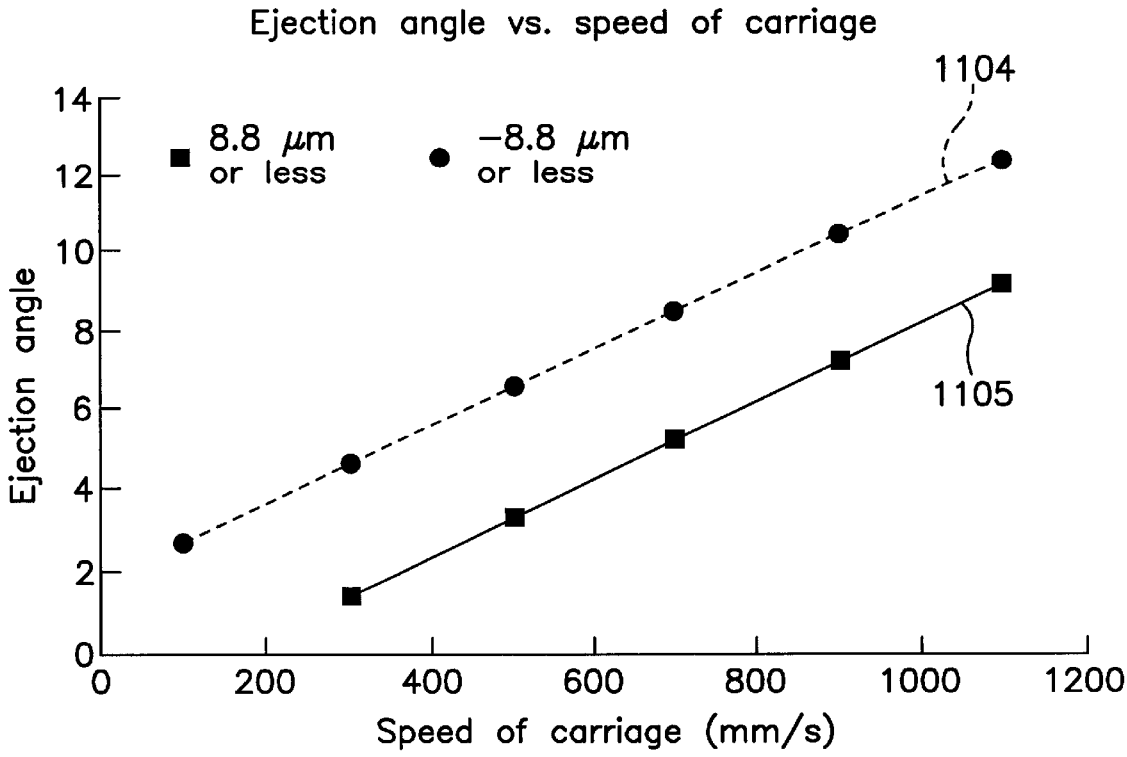
FIGS. 11(*a*) and 11(*b*) are a table and a graph illustrating the relationship between speeds Vc of the carriage and limit values of the ejection angles θ of droplets, wherein deviations fall within an allowable range (±8.8 μm)

FIGS. 11(*a*) and 11(*b*) are a table and a graph illustrating the relationship between the speeds Vc of the carriage and the limit values of the ejection angles θ of the droplets, wherein the deviation falls within the above-described allowable range (±8.8 μm).

In FIG. 11(*a*), a column denoted by reference numeral 1101 represents the moving speeds (mm/s) of the carriage; a column denoted by reference numeral 1102, the limit values of the ejection angles θ at which the deviation between the impact positions of the droplets becomes ±8.8 μm or less at the ejection rate having variations of ±30% caused by the variations in quantity of droplets in such a manner as to correspond to the speed of the carriage in the column 1101; and a column denoted by reference numeral 1103, the limit values of the ejection angles θ at which the deviation between the impact positions of the droplets becomes −8.8 μm or less.

FIG. 11(*b*) is read in a manner similar to FIG. 10(*b*). That is, in FIG. 11(*b*), the ejection angles θ existing in the coordinates between a straight line 1104 and a straight line 1105 fall within the allowable range with respect to a certain speed of the carriage.

Subsequently, explanation will be made on a method for determining the limit values of the ejection angles at the moving speed of the carriage of 500 mm/s in reference to Tables 5 to 8.

Here, as illustrated in Tables 5 to 8, in consideration of the variations in ejection rate caused by the variations in quantity of small droplets per se (at the ejection rate of 2.5 m/s ±30%), the ejection rates were set to three kinds of 2.5 m/s, 1.75 m/s and 3.25 m/s. Tables 5 to 8 illustrate the simulation results of the impact positions of the droplets and the deviations between the respective impact positions caused by differences in the respective ejection rates when the ejection angles θ are varied from 3° to 6.9° in increments of 0.1°.

As apparent from Table 5, the impact positions of the droplets at the ejection angle θ of, for example, 6.7° are 0.0002237 m (223.7 μm), 0.0002183 m (2218.3 μm) and 0.000227 m (227 μm) at the three kinds of ejection rates, respectively. The maximum deviation among the impact positions is almost −8.7 (μm). At the ejection angle θ of 6.8°, the deviation between the impact positions is almost −9.2 (μm), which exceeds −8.8 (μm) of the limit value of the allowable range.

From the above results, the ejection angle θ of 6.7° becomes one limit angle determining the allowable range.

TABLE 5

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 2.5 | 6 | 2.4863055 | 3000 | 0.0015 | 0.01 | 0.0002824 | 5.31076 | 0.5 | 0.000215 | |
| 1.75 | 6 | 1.7404139 | 3000 | 0.0015 | 0.01 | 0.0003099 | 4.8397485 | 0.5 | 0.0002117 | |

TABLE 5-continued

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 3.25 | 6 | 3.2321972 | 3000 | 0.0015 | 0.01 | 0.0002581 | 5.8127371 | 0.5 | 0.0002167 | −5.030292 |
| 2.5 | 6.1 | 2.4858457 | 3000 | 0.0015 | 0.01 | 0.0002825 | 5.3104598 | 0.5 | 0.0002163 | |
| 1.75 | 6.1 | 1.740092 | 3000 | 0.0015 | 0.01 | 0.0003099 | 4.8395523 | 0.5 | 0.0002126 | |
| 3.25 | 6.1 | 3.2315994 | 3000 | 0.0015 | 0.01 | 0.0002581 | 6.8123231 | 0.5 | 0.0002182 | −5.551442 |
| 2.5 | 6.2 | 2.4853783 | 3000 | 0.0015 | 0.01 | 0.0002825 | 5.3101547 | 0.5 | 0.0002175 | |
| 1.75 | 6.2 | 1.7397648 | 3000 | 0.0015 | 0.01 | 0.00031 | 4.8393528 | 0.5 | 0.0002136 | |
| 3.25 | 6.2 | 3.2309918 | 3000 | 0.0015 | 0.01 | 0.0002581 | 5.8119023 | 0.5 | 0.0002196 | −6.072742 |
| 2.5 | 6.3 | 2.4849033 | 3000 | 0.0015 | 0.01 | 0.0002825 | 5.3098447 | 0.5 | 0.0002187 | |
| 1.75 | 6.3 | 1.7394323 | 3000 | 0.0015 | 0.01 | 0.00031 | 4.8391501 | 0.5 | 0.0002145 | |
| 3.25 | 6.3 | 3.2303743 | 3000 | 0.0015 | 0.01 | 0.0002581 | 5.8114747 | 0.5 | 0.0002211 | −6.594196 |
| 2.5 | 6.4 | 2.4844207 | 3000 | 0.0015 | 0.01 | 0.0002825 | 5.3095297 | 0.5 | 0.00022 | |
| 1.75 | 6.4 | 1.7390945 | 3000 | 0.0015 | 0.01 | 0.00031 | 4.8389442 | 0.5 | 0.0002155 | |
| 3.25 | 6.4 | 3.2297469 | 3000 | 0.0015 | 0.01 | 0.0002581 | 5.8110403 | 0.5 | 0.0002226 | −7.115804 |
| 2.5 | 6.5 | 2.4839306 | 3000 | 0.0015 | 0.01 | 0.0002825 | 5.3092098 | 0.5 | 0.0002212 | |
| 1.75 | 6.5 | 1.7387514 | 3000 | 0.0015 | 0.01 | 0.00031 | 4.8387351 | 0.5 | 0.0002164 | |
| 3.25 | 6.5 | 3.2291098 | 3000 | 0.0015 | 0.01 | 0.0002581 | 5.8105991 | 0.5 | 0.000224 | −7.637568 |
| 2.5 | 6.6 | 2.4834329 | 3000 | 0.0015 | 0.01 | 0.0002825 | 5.308885 | 0.5 | 0.0002225 | |
| 1.75 | 6.6 | 1.738403 | 3000 | 0.0015 | 0.01 | 0.00031 | 4.8385228 | 0.5 | 0.0002174 | |
| 3.25 | 6.6 | 3.2284628 | 3000 | 0.0015 | 0.01 | 0.0002582 | 5.8101512 | 0.5 | 0.0002255 | −8.159491 |
| 2.5 | 6.7 | 2.4829276 | 3000 | 0.0015 | 0.01 | 0.0002826 | 5.3085552 | 0.5 | 0.0002237 | |
| 1.75 | 6.7 | 1.7380493 | 3000 | 0.0015 | 0.01 | 0.00031 | 4.8383072 | 0.5 | 0.0002183 | |
| 3.25 | 6.7 | 3.2278059 | 3000 | 0.0015 | 0.01 | 0.0002582 | 5.8096964 | 0.5 | 0.000227 | −8.681573 |
| 2.5 | 6.8 | 2.4824148 | 3000 | 0.0015 | 0.01 | 0.0002826 | 5.3082205 | 0.5 | 0.0002249 | |
| 1.75 | 6.8 | 1.7376904 | 3000 | 0.0015 | 0.01 | 0.00031 | 4.8380884 | 0.5 | 0.0002193 | |
| 3.25 | 6.8 | 3.2271392 | 3000 | 0.0015 | 0.01 | 0.0002582 | 5.8092349 | 0.5 | 0.0002285 | −9.203816 |
| 2.5 | 6.9 | 2.4818944 | 3000 | 0.0015 | 0.01 | 0.0002826 | 5.3078809 | 0.5 | 0.0002262 | |
| 1.75 | 6.9 | 1.7373261 | 3000 | 0.0015 | 0.01 | 0.0003101 | 4.8378664 | 0.5 | 0.0002202 | |
| 3.25 | 6.9 | 3.2264627 | 3000 | 0.0015 | 0.01 | 0.0002582 | 5.8087666 | 0.5 | 0.0002299 | −9.726223 |

In the same manner, the ejection angle θ of 3.4° is obtained as the other limit value from Table 8.

It is clearly found from Table 6 that the ejection angle θ at which the impact positions of the large and small droplets substantially accord with each other exists between 5.0°and 5.1°.

TABLE 6

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 2.5 | 5 | 2.4904873 | 3000 | 0.0015 | 0.01 | 0.0002823 | 5.3134904 | 0.5 | 0.0002027 | |
| 1.75 | 5 | 1.7433411 | 3000 | 0.0015 | 0.01 | 0.0003098 | 4.8415332 | 0.5 | 0.0002022 | |
| 3.25 | 5 | 3.2376335 | 3000 | 0.0015 | 0.01 | 0.0002579 | 5.8165027 | 0.5 | 0.000202 | 0.173257 |
| 2.5 | 5.1 | 2.4901032 | 3000 | 0.0015 | 0.01 | 0.0002823 | 5.3132396 | 0.5 | 0.0002039 | |
| 1.75 | 5.1 | 1.7430723 | 3000 | 0.0015 | 0.01 | 0.0003098 | 4.8413693 | 0.5 | 0.0002031 | |
| 3.25 | 5.1 | 3.2371342 | 3000 | 0.0015 | 0.01 | 0.0002579 | 5.8161568 | 0.5 | 0.0002035 | −0.346473 |
| 2.5 | 5.2 | 2.4897116 | 3000 | 0.0015 | 0.01 | 0.0002823 | 5.3129839 | 0.5 | 0.0002051 | |
| 1.75 | 5.2 | 1.7427981 | 3000 | 0.0015 | 0.01 | 0.0003098 | 4.8412021 | 0.5 | 0.0002041 | |
| 3.25 | 5.2 | 3.2366251 | 3000 | 0.0015 | 0.01 | 0.0002579 | 5.8158041 | 0.5 | 0.0002049 | −0.866338 |
| 2.5 | 5.3 | 2.4893124 | 3000 | 0.0015 | 0.01 | 0.0002823 | 5.3127232 | 0.5 | 0.0002064 | |
| 1.75 | 5.3 | 1.7425187 | 3000 | 0.0015 | 0.01 | 0.0003099 | 4.8410317 | 0.5 | 0.000205 | |
| 3.25 | 5.3 | 3.2361061 | 3000 | 0.0015 | 0.01 | 0.0002579 | 5.8154446 | 0.5 | 0.0002064 | −1.386338 |
| 2.5 | 5.4 | 2.4889056 | 3000 | 0.0015 | 0.01 | 0.0002824 | 5.3124575 | 0.5 | 0.0002076 | |
| 1.75 | 5.4 | 1.7422339 | 3000 | 0.0015 | 0.01 | 0.0003099 | 4.8408581 | 0.5 | 0.000206 | |
| 3.25 | 5.4 | 3.2355772 | 3000 | 0.0015 | 0.01 | 0.000258 | 5.8150782 | 0.5 | 0.0002079 | −1.906477 |
| 2.5 | 5.5 | 2.4884912 | 3000 | 0.0015 | 0.01 | 0.0002824 | 5.312187 | 0.5 | 0.0002088 | |
| 1.75 | 5.5 | 1.7419438 | 3000 | 0.0015 | 0.01 | 0.0003099 | 4.8406812 | 0.5 | 0.0002069 | |
| 3.25 | 5.5 | 3.2350385 | 3000 | 0.0015 | 0.01 | 0.000258 | 5.8147051 | 0.5 | 0.0002093 | −2.426754 |
| 2.5 | 5.6 | 2.4880692 | 3000 | 0.0015 | 0.01 | 0.0002824 | 5.3119115 | 0.5 | 0.0002101 | |
| 1.75 | 5.6 | 1.7416484 | 3000 | 0.0015 | 0.01 | 0.0003099 | 4.8405011 | 0.5 | 0.0002079 | |
| 3.25 | 5.6 | 3.23449 | 3000 | 0.0015 | 0.01 | 0.000258 | 5.8143251 | 0.5 | 0.0002108 | −2.947173 |
| 2.5 | 5.7 | 2.4876397 | 3000 | 0.0015 | 0.01 | 0.0002824 | 5.311631 | 0.5 | 0.0002113 | |
| 1.75 | 5.7 | 1.7413478 | 3000 | 0.0015 | 0.01 | 0.0003099 | 4.8403178 | 0.5 | 0.0002088 | |
| 3.25 | 5.7 | 3.2339315 | 3000 | 0.0015 | 0.01 | 0.000258 | 5.8139383 | 0.5 | 0.0002123 | −3.467734 |

TABLE 6-continued

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 2.5 | 5.8 | 2.4872025 | 3000 | 0.0015 | 0.01 | 0.0002824 | 5.3113456 | 0.5 | 0.0002126 | |
| 1.75 | 5.8 | 1.7410418 | 3000 | 0.0015 | 0.01 | 0.0003099 | 4.8401313 | 0.5 | 0.0002098 | |
| 3.25 | 5.8 | 3.2333633 | 3000 | 0.0015 | 0.01 | 0.000258 | 5.8135447 | 0.5 | 0.0002137 | −3.988440 |
| 2.5 | 5.9 | 2.4867578 | 3000 | 0.0015 | 0.01 | 0.0002824 | 5.3110553 | 0.5 | 0.0002138 | |
| 1.75 | 5.9 | 1.7407305 | 3000 | 0.0015 | 0.01 | 0.0003099 | 4.8399415 | 0.5 | 0.0002107 | |
| 3.25 | 5.9 | 3.2327852 | 3000 | 0.0015 | 0.01 | 0.000258 | 5.8131443 | 0.5 | 0.0002152 | −4.509292 |

TABLE 7

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 2.5 | 4 | 2.4939105 | 3000 | 0.0015 | 0.01 | 0.0002822 | 5.3157262 | 0.5 | 0.0001903 | |
| 1.75 | 4 | 1.7457373 | 3000 | 0.0015 | 0.01 | 0.0003097 | 4.8429946 | 0.5 | 0.0001927 | |
| 3.25 | 4 | 3.2420836 | 3000 | 0.0015 | 0.01 | 0.0002578 | 5.8195864 | 0.5 | 0.0001873 | 5.363547 |
| 2.5 | 4.1 | 2.4936023 | 3000 | 0.0015 | 0.01 | 0.0002822 | 5.3155249 | 0.5 | 0.0001915 | |
| 1.75 | 4.1 | 1.7455216 | 3000 | 0.0015 | 0.01 | 0.0003097 | 4.842863 | 0.5 | 0.0001936 | |
| 3.25 | 4.1 | 3.241683 | 3000 | 0.0015 | 0.01 | 0.0002578 | 5.8193088 | 0.5 | 0.0001888 | 4.845067 |
| 2.5 | 4.2 | 2.4932866 | 3000 | 0.0015 | 0.01 | 0.0002822 | 5.3153187 | 0.5 | 0.0001928 | |
| 1.75 | 4.2 | 1.7453006 | 3000 | 0.0015 | 0.01 | 0.0003097 | 4.8427282 | 0.5 | 0.0001946 | |
| 3.25 | 4.2 | 3.2412726 | 3000 | 0.0015 | 0.01 | 0.0002578 | 5.8190243 | 0.5 | 0.0001902 | 4.326469 |
| 2.5 | 4.3 | 2.4929632 | 3000 | 0.0015 | 0.01 | 0.0002822 | 5.3151075 | 0.5 | 0.000194 | |
| 1.75 | 4.3 | 1.7450743 | 3000 | 0.0015 | 0.01 | 0.0003098 | 4.8425902 | 0.5 | 0.0001955 | |
| 3.25 | 4.3 | 3.2408522 | 3000 | 0.0015 | 0.01 | 0.0002578 | 5.818733 | 0.5 | 0.0001917 | 3.807752 |
| 2.5 | 4.4 | 2.4926323 | 3000 | 0.0015 | 0.01 | 0.0002822 | 5.3148913 | 0.5 | 0.0001952 | |
| 1.75 | 4.4 | 1.7448426 | 3000 | 0.0015 | 0.01 | 0.0003098 | 4.8424489 | 0.5 | 0.0001965 | |
| 3.25 | 4.4 | 3.240422 | 3000 | 0.0015 | 0.01 | 0.0002578 | 5.8184349 | 0.5 | 0.0001932 | 3.288914 |
| 2.5 | 4.5 | 2.4922938 | 3000 | 0.0015 | 0.01 | 0.0002822 | 5.3146702 | 0.5 | 0.0001965 | |
| 1.75 | 4.5 | 1.7446057 | 3000 | 0.0015 | 0.01 | 0.0003098 | 4.8423044 | 0.5 | 0.0001974 | |
| 3.25 | 4.5 | 3.2399819 | 3000 | 0.0015 | 0.01 | 0.0002578 | 5.8181299 | 0.5 | 0.0001946 | 2.769954 |
| 2.5 | 4.6 | 2.4919477 | 3000 | 0.0015 | 0.01 | 0.0002822 | 5.3144442 | 0.5 | 0.0001977 | |
| 1.75 | 4.6 | 1.7443634 | 3000 | 0.0015 | 0.01 | 0.0003098 | 4.8421566 | 0.5 | 0.0001984 | |
| 3.25 | 4.6 | 3.293532 | 3000 | 0.0015 | 0.01 | 0.0002578 | 5.8178181 | 0.5 | 0.0001961 | 2.250869 |
| 2.5 | 4.7 | 2.491594 | 3000 | 0.0015 | 0.01 | 0.0002823 | 5.3142131 | 0.5 | 0.0001989 | |
| 1.75 | 4.7 | 1.7441158 | 3000 | 0.0015 | 0.01 | 0.0003098 | 4.8420056 | 0.5 | 0.0001993 | |
| 3.25 | 4.7 | 3.2390722 | 3000 | 0.0015 | 0.01 | 0.0002578 | 5.8174995 | 0.5 | 0.0001976 | 1.731659 |
| 2.5 | 4.8 | 2.4912327 | 3000 | 0.0015 | 0.01 | 0.0002823 | 5.3139772 | 0.5 | 0.0002002 | |
| 1.75 | 4.8 | 1.7438629 | 3000 | 0.0015 | 0.01 | 0.0003098 | 4.8418514 | 0.5 | 0.0002003 | |
| 3.25 | 4.8 | 3.2386025 | 3000 | 0.0015 | 0.01 | 0.0002579 | 5.8171741 | 0.5 | 0.0001991 | 1.212322 |
| 2.5 | 4.9 | 2.4908638 | 3000 | 0.0015 | 0.01 | 0.0002823 | 5.3137363 | 0.5 | 0.0002014 | |
| 1.75 | 4.9 | 1.7436046 | 3000 | 0.0015 | 0.01 | 0.0003098 | 4.8416939 | 0.5 | 0.0002012 | |
| 3.25 | 4.9 | 3.2381229 | 3000 | 0.0015 | 0.01 | 0.0002579 | 5.8168418 | 0.5 | 0.0002005 | 0.692855 |

TABLE 8

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 2.5 | 3 | 2.496574 | 3000 | 0.0015 | 0.01 | 0.0002821 | 5.3174664 | 0.5 | 0.000178 | |
| 1.75 | 3 | 1.7476018 | 3000 | 0.0015 | 0.01 | 0.0003097 | 4.8441319 | 0.5 | 0.0001832 | |
| 3.25 | 3 | 3.2455463 | 3000 | 0.0015 | 0.01 | 0.0002576 | 5.8219865 | 0.5 | 0.0001726 | 10.542274 |
| 2.5 | 3.1 | 2.4963419 | 3000 | 0.0015 | 0.01 | 0.0002821 | 5.3173147 | 0.5 | 0.0001792 | |
| 1.75 | 3.1 | 1.7474393 | 3000 | 0.0015 | 0.01 | 0.0003097 | 4.8440328 | 0.5 | 0.0001841 | |
| 3.25 | 3.1 | 3.2452445 | 3000 | 0.0015 | 0.01 | 0.0002577 | 5.8217773 | 0.5 | 0.0001741 | 10.024873 |
| 2.5 | 3.2 | 2.4961021 | 3000 | 0.0015 | 0.01 | 0.0002821 | 5.317158 | 0.5 | 0.0001804 | |
| 1.75 | 3.2 | 1.7472715 | 3000 | 0.0015 | 0.01 | 0.0003097 | 4.8439304 | 0.5 | 0.0001851 | |

TABLE 8-continued

| Ejection Rate (m/s) | Ejection Angle (°) | Vertical Rate (m/s) | Electrostatic Field (V) | Gap (m) | Quantity of Electric Charges (C/kg) | Flying Time (S) | Average Rate (m/s) | Speed of Carriage (m/s) | Impact Position (m) | Deviation between Impact Positions (μm) |
|---|---|---|---|---|---|---|---|---|---|---|
| 3.25 | 3.2 | 3.2449328 | 3000 | 0.0015 | 0.01 | 0.0002577 | 5.8215612 | 0.5 | 0.0001756 | 9.507372 |
| 2.5 | 3.3 | 2.4958548 | 3000 | 0.0015 | 0.01 | 0.0002821 | 5.3169964 | 0.5 | 0.0001817 | |
| 1.75 | 3.3 | 1.7470984 | 3000 | 0.0015 | 0.01 | 0.0003097 | 4.8438248 | 0.5 | 0.000186 | |
| 3.25 | 3.3 | 3.2446112 | 3000 | 0.0015 | 0.01 | 0.0002577 | 5.8213383 | 0.5 | 0.000177 | 8.989769 |
| 2.5 | 3.4 | 2.4955998 | 3000 | 0.0015 | 0.01 | 0.0002821 | 5.3168299 | 0.5 | 0.0001829 | |
| 1.75 | 3.4 | 1.7469199 | 3000 | 0.0015 | 0.01 | 0.0003097 | 4.8437159 | 0.5 | 0.000187 | |
| 3.25 | 3.4 | 3.2442798 | 3000 | 0.0015 | 0.01 | 0.0002577 | 5.8211086 | 0.5 | 0.0001785 | 8.472062 |
| 2.5 | 3.5 | 2.4953373 | 3000 | 0.0015 | 0.01 | 0.0002821 | 5.3166583 | 0.5 | 0.0001841 | |
| 1.75 | 3.5 | 1.7467361 | 3000 | 0.0015 | 0.01 | 0.0003097 | 4.8436038 | 0.5 | 0.0001879 | |
| 3.25 | 3.5 | 3.2439385 | 3000 | 0.0015 | 0.01 | 0.0002577 | 5.820872 | 0.5 | 0.00018 | 7.954250 |
| 2.5 | 3.6 | 2.4950671 | 3000 | 0.0015 | 0.01 | 0.0002821 | 5.3164818 | 0.5 | 0.0001854 | |
| 1.75 | 3.6 | 1.746547 | 3000 | 0.0015 | 0.01 | 0.0003097 | 4.8434884 | 0.5 | 0.0001889 | |
| 3.25 | 3.6 | 3.2435872 | 3000 | 0.0015 | 0.01 | 0.0002577 | 5.8206285 | 0.5 | 0.0001814 | 7.436331 |
| 2.5 | 3.7 | 2.4947894 | 3000 | 0.0015 | 0.01 | 0.0002822 | 5.3163004 | 0.5 | 0.0001866 | |
| 1.75 | 3.7 | 1.7463525 | 3000 | 0.0015 | 0.01 | 0.0003097 | 4.8433698 | 0.5 | 0.0001898 | |
| 3.25 | 3.7 | 3.2432262 | 3000 | 0.0015 | 0.01 | 0.0002577 | 5.8203783 | 0.5 | 0.0001829 | 6.918302 |
| 2.5 | 3.8 | 2.494504 | 3000 | 0.0015 | 0.01 | 0.0002822 | 5.3161139 | 0.5 | 0.0001878 | |
| 1.75 | 3.8 | 1.7461528 | 3000 | 0.0015 | 0.01 | 0.0003097 | 4.843248 | 0.5 | 0.0001908 | |
| 3.25 | 3.8 | 3.2428552 | 3000 | 0.0015 | 0.01 | 0.0002577 | 5.8201211 | 0.5 | 0.0001844 | 6.400163 |
| 2.5 | 3.9 | 2.494211 | 3000 | 0.0015 | 0.01 | 0.0002822 | 5.3159226 | 0.5 | 0.0001891 | |
| 1.75 | 3.9 | 1.7459477 | 3000 | 0.0015 | 0.01 | 0.0003097 | 4.8431229 | 0.5 | 0.0001917 | |
| 3.25 | 3.9 | 3.2424743 | 3000 | 0.0015 | 0.01 | 0.0002577 | 5.8195872 | 0.5 | 0.0001858 | 5.881912 |

As apparent from the above description, the same simulation as described above is conducted while the moving speed of the carriage is changed, thus obtaining the limit values of the ejection angles illustrated in FIG. 11(*a*).

As a consequence, it is found from FIG. 11(*b*) that in order to eject the small droplets (20 ng) from the large-diameter nozzle and make the deviation between the impact positions caused by the variations in ejection rate fall within the above-described allowable range at the moving speed of the carriage of 400 mm/s or higher, the ejection angle of the ink droplet is needed to be at least 2.4° or more.

(Second Embodiment)

Figure 12:
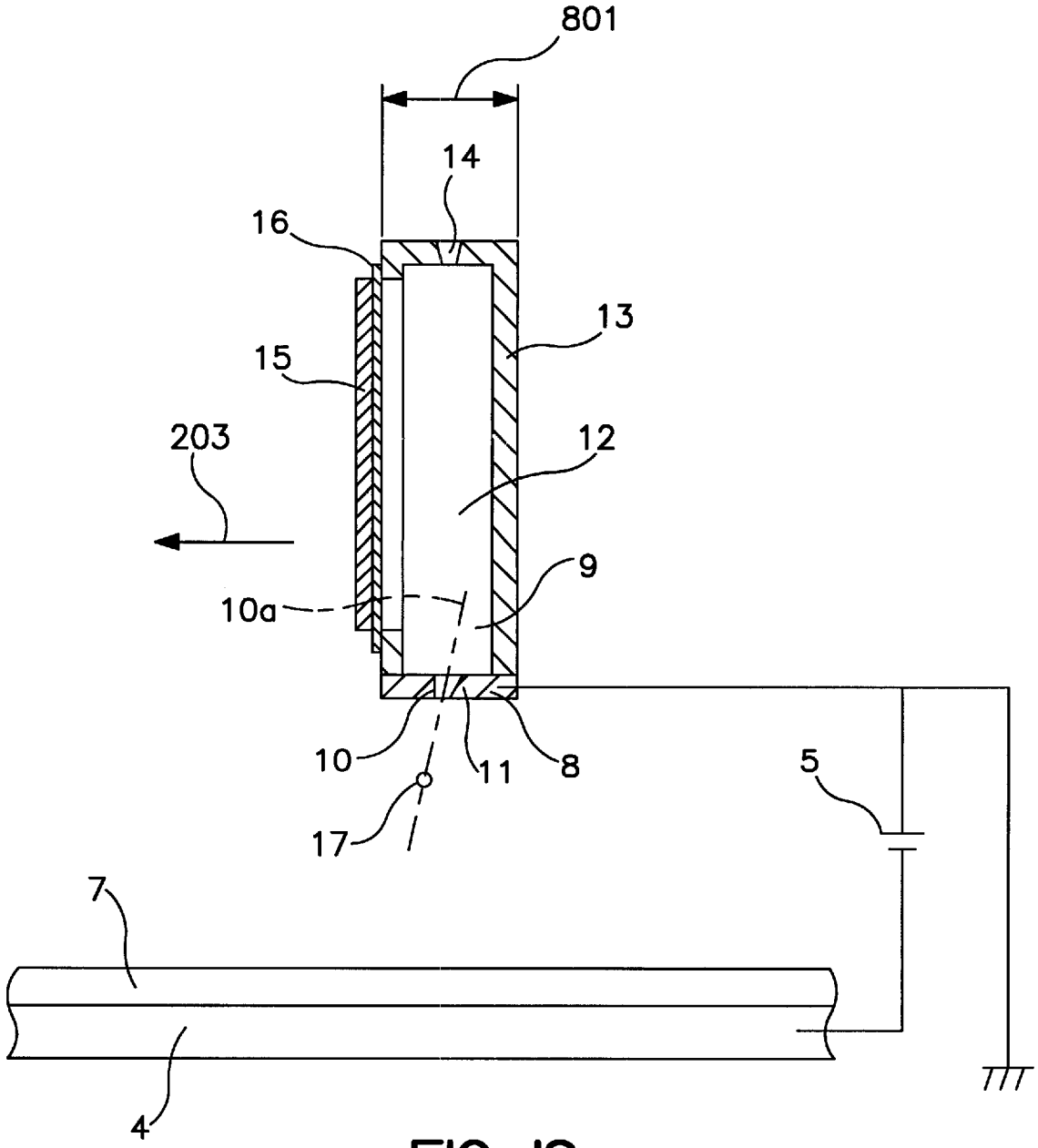
FIG. 12 is a cross-sectional view showing an ink jet head in a second embodiment according to the present invention.

FIG. 12 shows a cross-sectional view showing an ink jet head 1 in a second embodiment according to the present invention. Differences from the ink jet head 1 shown in FIG. 2 reside in that a nozzle surface 11 is disposed in parallel to an opposite electrode 4, and further, that an axis 10*a* of a nozzle 10 is inclined with respect to -the nozzle surface 11. The other configuration is the same as that in the first embodiment. With this configuration, an ink droplet 17 can be ejected slantwise in an electrostatic field, thus producing the same advantageous results as those in the first embodiment. Moreover, with the configuration in the first embodiment, the width 801 of the nozzle plate 8 in the moving direction 203 of the ink jet head 1 need be increased in the case where the plurality of nozzles 10 are disposed in the moving direction of the ink jet head 1, thereby inducing nonuniform electrostatic field unfavorably. However, in the present embodiment, since the nozzle surface 11 is parallel to the opposite electrode 4, a uniform electrostatic field can be achieved even if the plurality of nozzles 10 are disposed in the moving direction of the ink jet head 1 and the width of the nozzle plate 8 in the moving direction of the ink jet head 1 is increased.

As described above, in this second embodiment, the nozzle surface 11 is disposed in parallel to the opposite electrode 4 and the axis of the nozzle 10 is inclined with respect to the nozzle surface 11, thus readily achieving the configuration in which the plurality of nozzles 10 are provided in the moving direction of the ink jet head 1.

(Third Embodiment)

Figure 13:
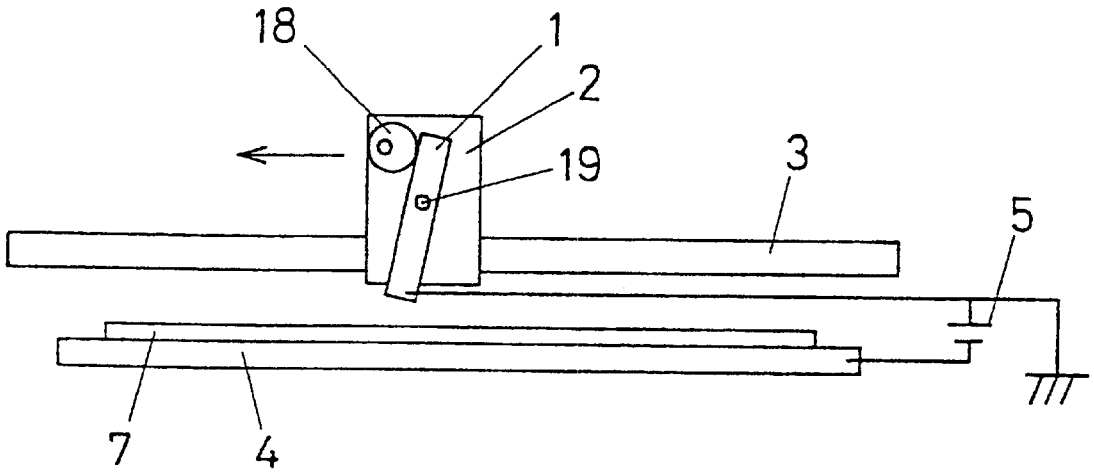
FIG. 13 is a schematic view showing the configuration of an ink jet recording apparatus in a third embodiment according to the present invention.

FIG. 13 schematically shows the configuration of an ink jet recording apparatus in a third embodiment according to the present invention. Differences from the ink jet recording apparatus in the first embodiment reside in that the speed of a carriage can be varied as relative moving speed switching means claimed under the section of "What Is Claimed Is," and that an eccentric cam 18 and an ink jet head rotating shaft 19 are provided as ejection angle switching means claimed under the section of "What Is Claimed Is."

Explanation will be made on the operation of the ink jet recording apparatus configured as described above. In some cases, recording resolution may be changed as required for a high quality of an image or a high speed in the ink jet recording apparatus. In this case, the recording resolution is increased while the moving speed of the carriage 2 is decreased if a high quality of an image is required. The recording resolution is decreased while the moving speed of the carriage 2 is increased if a high speed is required. In the case where the speed of the carriage 2 is varied, it is preferable that the ejection angle of the slantwise ejection should be changed according to the speed of the carriage 2 in view of the deviation of the impact positions. In the present embodiment, the eccentric cam 18 is rotated by a device, not shown, according to the speed of the carriage 2, and then, the ink jet head 1 is rotated accordingly on the ink jet head rotating shaft 19, so that the election angle of the slantwise ejection can be switched to a desired angle. For example, if the speed of the carriage 2 is high, the ink is ejected more slantwise.

As described above, the ink jet recording apparatus in the present embodiment is configured such that the slantwise ejection angle is switched to a desired angle according to the speed of the carriage 2. Thus, it is possible to provide the ink jet recording apparatus in which the deviation of the impact positions is small even at the mode of a high quality of an image and the mode of a high speed and the dot modulation can be achieved.

(Fourth Embodiment)

Figure 14:
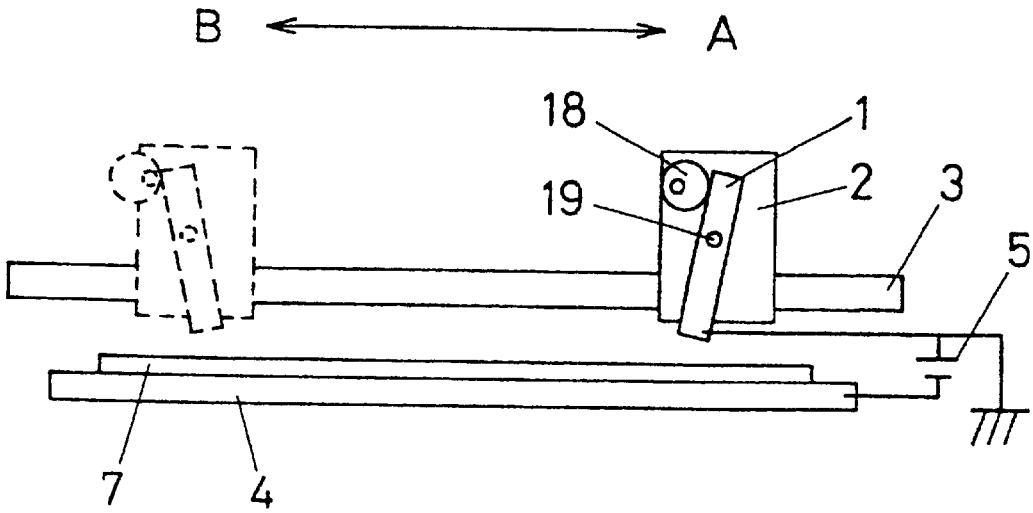
FIG. 14 is a schematic view showing the configuration of an ink jet recording apparatus in a fourth embodiment according to the present invention.
Figure 15:
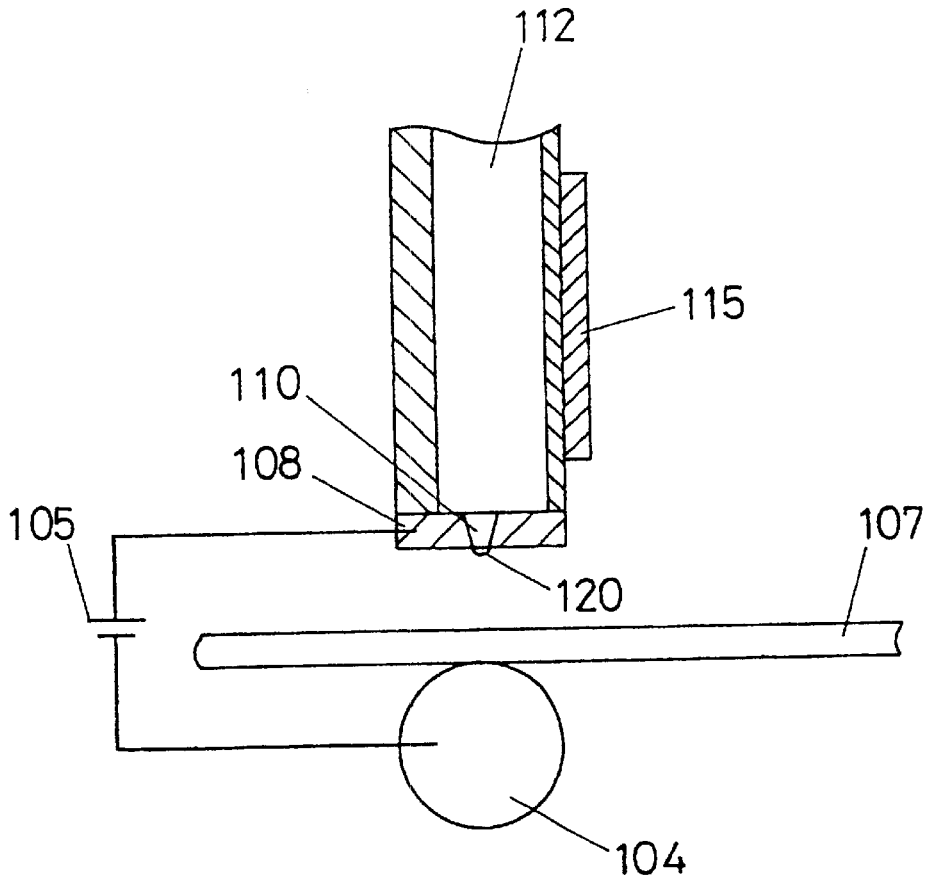
Fig. 15 PRIOR ART
FIG. 15 is a schematic cross-sectional view showing an ink jet recording apparatus in the prior art.

FIG. 14 schematically shows the configuration of an ink jet recording apparatus In a fourth embodiment according to the present invention. Differences from the ink jet recording apparatus shown in FIG. 13 reside in that ink droplets 17 are ejected during both an advancing operation and a returning operation of a carriage 2 with respect to a recording sheet 7, and that an ink jet head 1 is rotated in such a manner that the ejection directions of the slantwise ejection during both the advancing operation and the returning operation become symmetric with respect to a plane perpendicular to the moving direction of the carriage 2.

Explanation will be made on the operation of the ink jet recording apparatus configured as described above. An eccentric cam 18 is rotated in such a manner that the ink jet head 1 is positioned at a position indicated by a solid line during the operation from a point A to a point B or at a position indicated by a broken line during the operation from the point B to the point A. At this moment, it is preferable that there should be provided a sensor or the like for detecting the moving direction relative to the recording sheet, and that the eccentric cam 18 should switch the ejection direction of the ink to be ejected from a nozzle according to the relative movement direction determined by the sensor.

As described above, in this fourth embodiment, the ink ejection direction is inclined with respect to the plane perpendicular to the moving direction of the carriage 2, and is set in the moving direction of the ink jet head relative to the recording sheet, in particular, the slantwise ejection directions during the advancing and returning operations of the carriage 2 are symmetrical with respect to the plane perpendicular to the moving direction of the carriage 2. Consequently, it is possible to provide the ink jet recording apparatus in which the deviation of the impact positions is small and the dot modulation can be achieved even if so-called shuttle recording is performed.

As described above, according to the present invention, it is possible to provide the ink jet recording apparatus comprising: the ink jet head including the pressure chamber containing the ink therein, the nozzle communicating with the pressure chamber and being adapted to eject the ink, and the pressure applying means for applying the pressure to the pressure chamber; the relative movement means for relatively moving the ink jet head and the recording sheet; the opposite electrode disposed at the position opposite to the ink jet head; and the voltage applying means for applying the voltage between the ink and the opposite electrode, wherein the ink is ejected from the nozzle in the direction slantwise with respect to the plane perpendicular to the relative movement direction by the relative movement means and in the relative movement direction of the ink jet head with respect to the recording sheet by the relative movement means, thereby reducing the deviation of the impact positions and generation of clogging and enhancing the manufacturing yield if the small droplets are ejected from the large-diameter nozzle.

Furthermore, the pressure varying means for varying the pressure of the pressure applying means is provided so as to vary the quantity of the ink to be ejected from the nozzle, thus providing the ink jet recording apparatus in which the dot modulation can be achieved.

Moreover, the axis of the nozzle is inclined with respect to the nozzle surface, so that it is possible to readily achieve the configuration where the plurality of nozzles are provided in the moving direction of the ink jet head.

Additionally, there are provided the relative moving speed switching means for switching the relative moving speed of the ink jet head relative to the recording sheet by the relative movement means and the ejection angle switching means for switching the ejection angle of the ink according to the relative moving speed of the ink jet head relative to the recording sheet by the relative movement means, thus providing the ink jet recording apparatus and recording method in which the deviation of the impact positions is small and the dot modulation can be achieved even at the mode of the high quality of an image and the mode of the high speed.

Furthermore, the ink jet head is operated in a shuttling manner with respect to, e.g., the recording sheet by the relative movement means, and the ink is ejected from the nozzle during both the advancing operation and the returning operation, wherein the ejection directions of the ink droplets during the advancing operation and the returning operation are symmetrical with respect to the plane perpendicular to the relative movement direction by the relative movement means, thus providing the ink jet recording apparatus and recording method in which the deviation of the impact positions is small and the dot modulation can be achieved even in the shuttle recording operation.

As apparent from the above description, the present invention has the advantage in that it is possible to further reduce the deviation between the impact positions of the ink droplets in the case where the small droplets are ejected from the large-diameter nozzle.

Moreover, the present invention has the advantage in that the deviation between the impact positions of the large and small ink droplets on the recording sheet can be further reduced to thus achieve the dot modulation.

What is claimed is:

1. An ink jet recording apparatus comprising:

an ink jet head for ejecting ink from a nozzle;

relative movement means for relatively moving said ink jet head and a recording sheet;

an opposite electrode disposed at a position opposite to said ink jet head; and voltage applying means for applying a voltage between said ink and said opposite electrode;

wherein an ejection direction of the ink to be ejected from said nozzle is inclined with respect to a direction of an electric field generated by said voltage applying means and has a component in a relative movement direction of said ink jet head relative to said recording sheet.

2. The ink jet recording apparatus as set forth in claim 1, wherein the direction of said electric field signifies a direction of an electric field in a vicinity of said opposite electrode;

the ejection direction of said ink being inclined with respect to the direction of said electric field signifies the ejection direction of said ink being inclined with respect to a plane perpendicular to the relative movement direction by said relative movement means; and the ejection direction of the ink to be ejected from said nozzle is parallel to or within a plane including a perpendicular line drawn from said nozzle down to said opposite electrode and a straight line drawn from said nozzle toward the relative movement direction by said relative movement means.

3. The ink jet recording apparatus as set forth in claim 1, wherein said ink jet head includes: a pressure chamber containing said ink therein; the nozzle communicating with said pressure chamber and ejecting the ink; and pressure applying means for applying a pressure to said pressure chamber.

4. The ink jet recording apparatus as set forth in claim 3, further comprising pressure varying means for varying the pressure of said pressure applying means, so as to vary a quantity of the ink to be ejected from said nozzle.

5. The ink jet recording apparatus as set forth in claim 4, wherein said pressure applying means includes a vibrating plate attached to said pressure chamber and a piezoelectric element for vibrating said vibrating plate, and said pressure varying means switches an energizing waveform to said piezoelectric element.

6. The ink jet recording apparatus as set forth in claim 1, wherein a nozzle surface having an ejection port of said nozzle is arranged slantwise with respect to a plane perpendicular to a perpendicular line drawn from said nozzle down to said opposite electrode, and said ink is ejected perpendicularly to said nozzle surface.

7. The ink jet recording apparatus as set forth in claim 1, wherein a nozzle surface having an ejection surface of said nozzle is arranged in parallel with respect to a plane perpendicular to a perpendicular line drawn from said nozzle down to said opposite electrode, and said ink is ejected slantwise to said nozzle surface.

8. The ink jet recording apparatus as set forth in claim 7, wherein an axis of said nozzle is inclined with respect to said nozzle surface.

9. The ink jet recording apparatus as set forth in claim 1, further comprising:

relative moving speed switching means for switching a relative moving speed between said ink .jet head and said recording sheet which are relatively moved by said relative movement means; and ejection angle switching means for switching an ejection angle of the ink according to the relative moving speed between said ink jet head and said recording sheet.

10. The ink jet recording apparatus as set forth in claim 1, wherein said relative movement means allows a shuttling operation of said ink jet head with respect to said recording sheet, the ink being ejected from said nozzle during both an advancing operation and a returning operation, wherein the ejection directions of ink droplets during the advancing and returning operations are symmetrical with respect to a plane perpendicular to the relative movement direction by said relative movement means.

11. An ink jet recording method comprising the steps of:

inputting a desired recording quality;

switching a relative moving speed of an ink jet head for ejecting ink from a nozzle onto a recording sheet according to said recording quality; and switching an ejection direction of the ink to be ejected from said nozzle according to said relative moving speed.

12. The ink jet recording method as set forth in claim 11, wherein the ejection direction of said ink is inclined with respect to a plane perpendicular to said relative movement direction, and has a component in the relative movement direction of said ink jet head with respect to said recording sheet.

13. An ink jet recording method comprising the steps of:

determining a relative movement direction of an ink jet head for ejecting ink from a nozzle onto a recording sheet; and switching an ejection direction of the ink to be ejected from said nozzle according to said relative movement direction;

wherein the ejection direction of said ink is inclined with respect to a plane perpendicular to said relative movement direction, and has a component in the relative movement direction of said ink jet head with respect to said recording sheet.

14. The ink jet recording method as set forth in claim 13, wherein said ink jet head or said recording sheet performs a shuttling operation, the ejection directions of said ink during advancing and returning operations are symmetrical with respect to the plane perpendicular to said relative movement direction.

15. In an ink jet recording apparatus having a nozzle in an ink jet head for ejecting ink droplets on a recording sheet, and an electrode disposed opposing the ink jet head, the method comprising the steps of:

(a) applying a voltage between the electrode and the ink jet head to form an electric field in a plane perpendicular to the recording sheet;

(b) ejecting ink droplets, of various size between minimum and maximum sizes, and of various ejection velocities, in a selected angular direction with respect to the direction of the electric field;

(c) moving the ink jet head relative to the recording sheet;

(d) ejecting the ink droplets from the nozzle at the selected angular direction, and according to a predetermined moving speed between the nozzle and the recording sheet, to impact the sheet with the ink droplets, of various size between minimum and maximum sizes, at a substantially constant impact position on the recording sheet.

16. The method of claim 15, wherein step (d) includes inclining the nozzle in the selected angular direction and according to the predetermined moving speed between the nozzle and the recording sheet, to impact the sheet with the ink droplets at the substantially constant impact position on the recording sheet.

17. The method of claim 15, wherein step (d) includes inclining the nozzle in the angular direction and in a direction of movement of the nozzle relative to the recording sheet to impact the sheet with the ink droplets at the substantially constant impact position on the recording sheet.

18. An ink jet recording apparatus comprising:

an ink jet head for ejecting ink from a nozzle;

relative movement means for relatively moving said ink jet head and a recording sheet;

an opposite electrode disposed at a position opposite to said ink jet head;

voltage applying means for applying a voltage between said ink and said opposite electrode;

wherein an ejection direction of the ink to be ejected from said nozzle is inclined with respect to a direction of an electric field generated by said voltage applying means and has a component in a relative movement direction of said ink jet head relative to said recording sheet;

relative moving speed switching means for switching a relative moving speed between said ink jet head and said recording sheet which are relatively moved by said relative movement means; and ejection angle switching means for switching an ejection angle of the ink according to the relative moving speed between said ink jet head and said recording sheet.

* * * * *